US011459202B2

(12) United States Patent
Shimodaira et al.

(10) Patent No.: US 11,459,202 B2
(45) Date of Patent: Oct. 4, 2022

(54) SHEET HANDLING APPARATUS AND SHEET HANDLING METHOD

(71) Applicant: Glory Ltd., Himeji (JP)

(72) Inventors: Yuji Shimodaira, Himeji (JP); Eiki Yamamoto, Himeji (JP); Yoshiki Ono, Himeji (JP)

(73) Assignee: GLORY LTD., Himeji (JP)

( * ) Notice: Subject to any disclaimer, the term of this patent is extended or adjusted under 35 U.S.C. 154(b) by 13 days.

(21) Appl. No.: 17/110,324

(22) Filed: Dec. 3, 2020

(65) Prior Publication Data

US 2021/0171309 A1 Jun. 10, 2021

(30) Foreign Application Priority Data

Dec. 6, 2019 (JP) ..... JP2019-221638

(51) Int. Cl.
*B65H 31/30* (2006.01)
*B65H 29/14* (2006.01)
*B65H 29/38* (2006.01)

(52) U.S. Cl.
CPC ..... *B65H 31/30* (2013.01); *B65H 29/14* (2013.01); *B65H 29/38* (2013.01); *B65H 2404/64* (2013.01); *B65H 2701/1912* (2013.01)

(58) Field of Classification Search
CPC ..... B65H 29/26; B65H 29/34; B65H 29/38; B65H 29/46; B65H 31/00; B65H 31/02; B65H 31/30; B65H 2404/64; B65H 2701/1912; G07D 11/009; G07D 11/0093; G07D 11/12; G07D 11/125; B65B 5/106; B65B 35/40
See application file for complete search history.

(56) References Cited

U.S. PATENT DOCUMENTS

| | | | | |
|---|---|---|---|---|
| 7,059,599 | B2 | 6/2006 | Lewis | |
| 10,169,944 | B2 * | 1/2019 | Razzaboni | B65B 7/02 |
| 2010/0189379 | A1 * | 7/2010 | Razzaboni | E05G 7/001 53/284.7 |
| 2015/0083792 | A1 | 3/2015 | Bullock et al. | |
| 2021/0171302 | A1 * | 6/2021 | Shimodaira | B65H 43/06 |

FOREIGN PATENT DOCUMENTS

| | | | | |
|---|---|---|---|---|
| EP | 1 755 089 | A2 | 2/2007 | |
| EP | 2 743 895 | A1 | 6/2014 | |
| EP | 3744669 | A1 * | 12/2020 | B65H 29/34 |
| GB | 2551204 | A * | 12/2017 | B65H 29/46 |

OTHER PUBLICATIONS

Extended European Search Report dated May 6, 2021 in European Application No. 20210035.0.

* cited by examiner

*Primary Examiner* — Prasad V Gokhale
(74) *Attorney, Agent, or Firm* — Xsensus LLP

(57) ABSTRACT

A sheet handling apparatus for storing sheets into a storage bag that includes an opening and a frame having a gate for opening and closing the opening, includes: a mounting unit to which the frame of the storage bag is capable of being detachably mounted; a transport unit configured to transport sheets one by one; and a storage mechanism configured to stack the sheets transported by the transport unit, in a stacking area on the frame mounted to the mounting unit, and to push the sheets stacked in the stacking area into the storage bag through the opening of the storage bag to store the sheets in the storage bag.

14 Claims, 16 Drawing Sheets

SHEET HANDLING APPARATUS AND SHEET HANDLING METHOD

CROSS REFERENCE TO RELATED APPLICATION

This application is based on and claims priority to Japanese Patent Application No. 2019-221638 filed on Dec. 6, 2019. The entire disclosure of the above-identified application, including the specification, drawings and claims is incorporated herein by reference and its entirety.

TECHNICAL FIELD

The present disclosure relates to a sheet handling apparatus and a sheet handling method that handle sheets.

BACKGROUND ART

Conventionally, sheet handling apparatuses for handling sheets have been used. For example, U.S. Pat. No. 7,059,599 discloses an apparatus including a stacking unit that stacks banknotes, and a storage unit that is disposed beneath the stacking unit, receives the banknotes from the stacking unit, and stores the received banknotes therein.

The stacking unit includes two members on which banknotes are stacked, and another member for pushing the banknotes stacked on these two members into the storage unit from the upper side. The two members for stacking banknotes are disposed facing each other in the horizontal direction. Each member is pivotable downward from the position at which the upper surface thereof is horizontal. Like the stacking unit, the storage unit is also provided with two members that are disposed facing each other in the horizontal direction and are pivotable downward.

Banknotes are stacked on the upper surface of the stacking unit with the two members horizontally disposed. When the other member disposed above the stacked banknotes pushes the banknotes downward, the two members on which the banknotes are stacked pivot downward. When the two members of the stacking unit pivot downward, the two members of the storage unit also pivot downward. The banknotes are pushed into the storage unit through a gap between the pivoted and members, and are stored in the storage unit.

SUMMARY

In the conventional art described above, the size of the apparatus is disadvantageously increased. For example, the stacking unit and the storage unit need to be separately provided in the apparatus. In addition, spaces for the pivotable members of the stacking unit and the pivotable members of the storage unit need to be secured in the apparatus.

The present disclosure is made in view of the problems of the conventional art. The present disclosure addresses issues, as discussed herein, with a sheet handling apparatus and a sheet handling method that realize space-saving regarding stacking and storage of sheets.

The present disclosure provides a sheet handling apparatus for storing sheets into a storage bag. The storage bag includes a frame having a gate for opening and closing an opening of the storage bag. The sheet handling apparatus includes: a mounting unit to which the frame of the storage bag is capable of being detachably mounted; a transport unit configured to transport the sheets one by one; and a storage mechanism configured to stack the sheets transported by the transport unit, in a stacking area on the frame mounted to the mounting unit. The storage mechanism is configured to push the sheets stacked in the stacking area into the storage bag through the opening of the storage bag to store these sheets in the storage bag.

DETAILED DESCRIPTION

Figure 1:
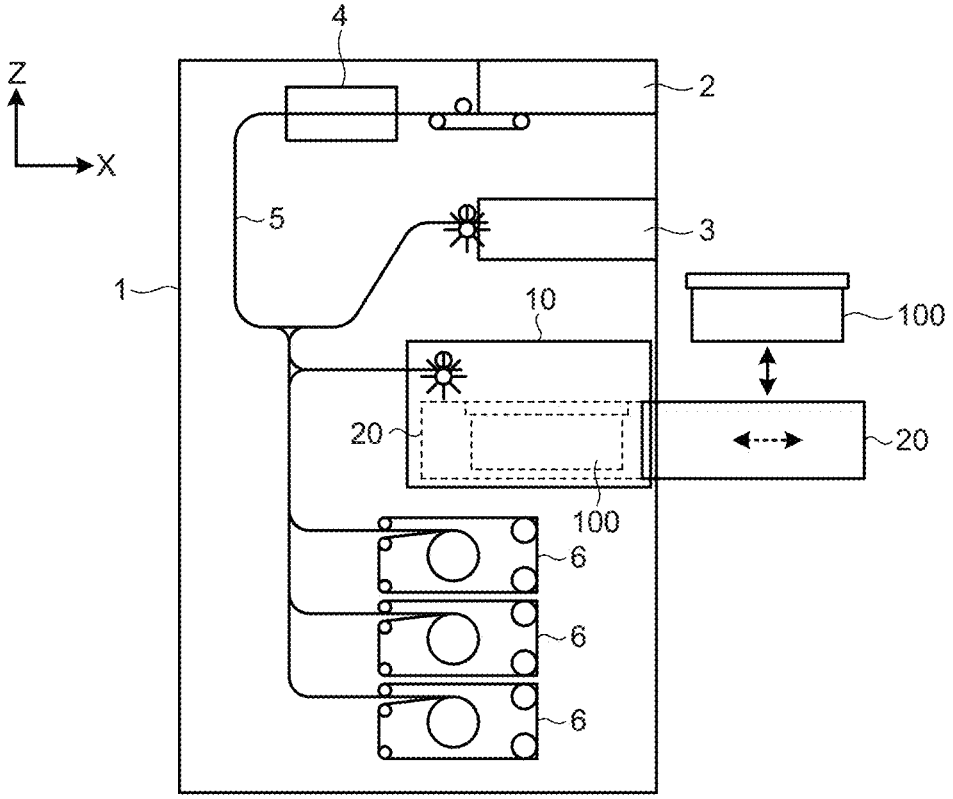
FIG. 1 is a schematic cross-sectional view showing a configuration of a banknote handling apparatus according to an embodiment of the present disclosure.

Hereinafter, a sheet handling apparatus and a sheet handling method according to the present disclosure will be described with reference to the drawings. FIG. 1 is a schematic cross-sectional view showing a configuration of a banknote handling apparatus 1 that is an example of the sheet handling apparatus according to an embodiment of the present disclosure. The sheet handling apparatus is configured to handle sheets. A banknote is an example of a sheet that can be handled by the sheet handling apparatus. The banknote handling apparatus 1 handles banknotes. In the drawings showing the apparatus configuration of the present embodiment, three axes of X, Y, and Z orthogonal to each other are shown so that the relationship between components shown in each drawing can be understood. As for components to be mounted/dismounted, directions in their mounted states are indicated by the three axes.

As shown in FIG. 1, the banknote handling apparatus 1 includes a storage mechanism 10. The storage mechanism 10 includes a mounting unit 20 that allows a storage bag 100 to be mounted therein and dismounted therefrom. The storage bag 100 is used for storing banknotes that are examples of sheets. The storage mechanism 10 is disposed inside the housing of the banknote handling apparatus 1. The mounting unit 20 can be drawn out from the storage mechanism 10. The storage bag 100 can be mounted to and dismounted from the mounting unit 20 drawn from the storage mechanism 10. For example, the storage bag 100 is mounted/dismounted from the upper side of the mounting unit 20 as shown by a solid-line arrow in FIG. 1. The direction for mounting and dismounting the storage bag 100 is not limited thereto. The storage bag 100 may be mounted to and dismounted from a lateral side of the mounting unit 20. As shown by a broken line in FIG. 1, the mounting unit 20 to which the storage bag 100 has been mounted can be returned into the storage mechanism 10. Preferably, the banknote handling apparatus 1 may further include a transport unit 5 for transporting banknotes. The storage mechanism 10 receives banknotes transported by the transport unit 5 therein and stores the received banknotes into the storage bag 100 mounted in the mounting unit 20.

Preferably, the banknote handling apparatus 1 may further include an inlet 2, an outlet 3, a recognition unit 4 and a storage unit 6. The banknote handling apparatus 1 can execute dispensing and depositing of banknotes. FIG. 1 shows an example of the banknote handling apparatus 1 including a plurality of storage units 6, but the number of storage units are not particularly limited. Each storage unit 6 is configured to store banknotes therein. Each storage unit 6 may further be configured to feed out the stored banknotes therefrom. In dispensing, banknotes, which have been selected to be dispensed from among banknotes being stored in the storage units 6, are fed out from the storage units 6. The transport unit 5 transports the banknotes from the storage units 6 to the outlet 3. The banknotes transported by the transport unit 5 are dispensed to outside of the banknote handling apparatus 1 through the outlet 3.

In depositing, banknotes to be deposited are received in the inlet 2. The banknotes are fed one by one into the apparatus 1 through the inlet 2. The transport unit 5 transports the banknotes fed into the apparatus 1. The recognition unit 4 recognizes and counts the banknotes being transported by the transport unit 5. For example, the recognition unit 4 recognizes denomination, fitness, and authenticity of each banknote, and counts the number of banknotes for each denomination, the total number of banknotes, and the total amount of the banknotes. Hereinafter, recognition process of banknotes by the recognition unit 4 may include counting of banknotes. Based on the recognition result of the recognition unit 4, each banknote recognized by the recognition unit 4 is transported to any of the storage units 6, the storage mechanism 10, and the outlet 3. To each of the storage units 6, a kind of banknote to be stored therein can be set. For example, to each storage unit 6, the denomination of banknotes to be stored therein is set. A banknote, which is determined not to be deposited as the result of the recognition by the recognition unit 4, is discharged as a reject banknote from the outlet 3. For example, a banknote that cannot be recognized by the recognition unit 4 and a banknote that is recognized as a counterfeit note by the recognition unit 4 are discharged from the outlet 3. Meanwhile, a banknote that can be deposited is stored in a storage unit 6 corresponding to the kind of the banknote, based on the recognition result. For example, banknotes are stored in the respective storage units 6 by denomination.

For example, each storage unit 6 is configured to reel up banknotes together with tapes onto an outer circumferential surface of a drum rotating to store the banknotes, and to feed out the stored banknotes to the transport unit 5 by the drum rotating in a direction opposite to the direction to store banknotes. This configuration is an example of the storage unit 6. The configuration of the storage unit 6 is not particularly limited as long as the storage unit 6 is configured to store banknotes therein. The storage bag 100 mounted to the mounting unit 20 of the storage mechanism 10 stores banknotes therein but does not feed out banknotes. For example, when a storage unit 6 is full and cannot store a banknote therein anymore, this banknote is transported to the storage mechanism 10 and stored in the storage bag 100. For another example, a banknote, which can be deposited but whose denomination is set to none of the storage units 6, is transported to the storage mechanism 10 and stored in the storage bag 100. The storage bag 100 is also used for a collection process of collecting banknotes from storage units 6 to the outside of the apparatus 1. Specifically, banknotes to be collected are fed out from the storage units 6, transported to the storage mechanism 10, and stored in the storage bag 100. The storage mechanism 10 can close an opening portion of the storage bag 100 having the banknotes stored therein. A person in charge of banknote collection draws out the mounting unit 20 from the storage mechanism 10, and takes out the storage bag 100 having the banknotes stored therein, upward from the mounting unit 20 as shown in FIG. 1. The banknotes stored in the storage bag 100 are collected together with the storage bag 100.

Figure 2:
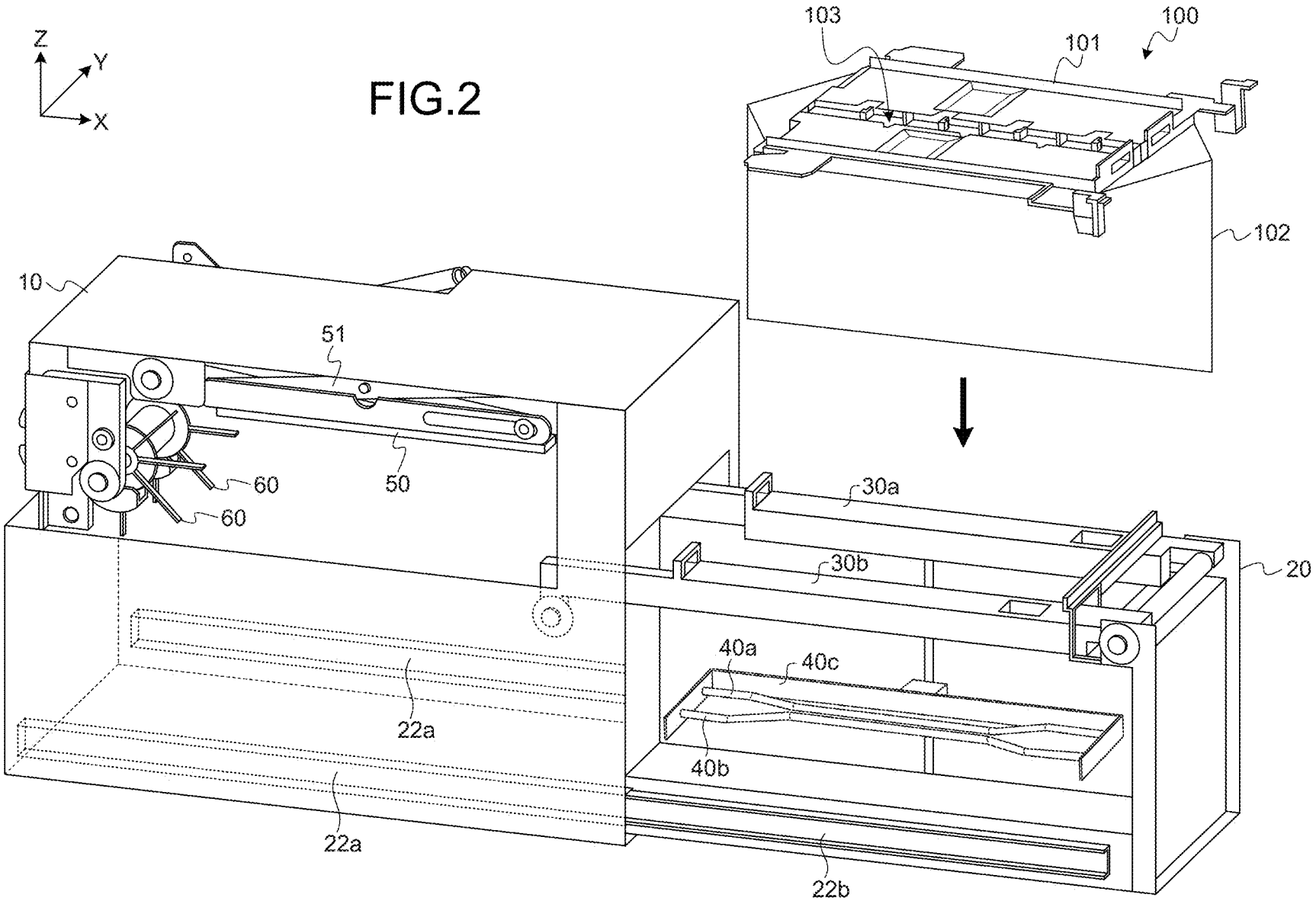
FIG. 2 illustrates a method for mounting and dismounting a storage bag to/from a mounting unit drawn out from a storage mechanism.
Figure 3:
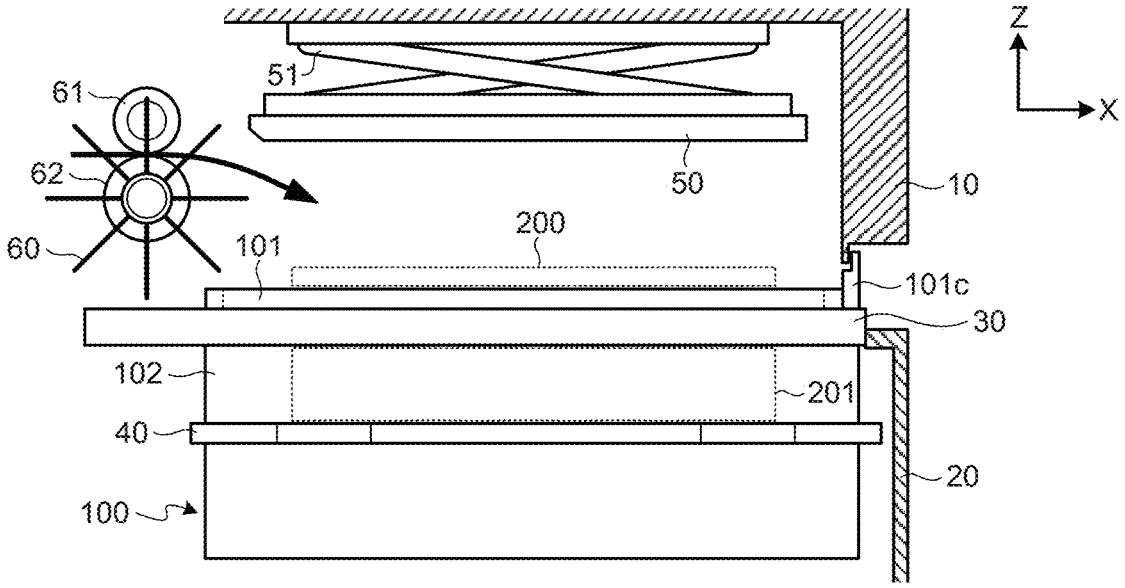
FIG. 3 illustrates a method for storing banknotes in the storage bag.

FIG. 2 illustrates a method for mounting and dismounting the storage bag 100 to/from the mounting unit 20 drawn out from the storage mechanism 10. FIG. 3 illustrates a method for storing banknotes into the storage bag 100. Although not shown in FIG. 2 and FIG. 3, the storage mechanism 10 includes: a detection member 70 that detects an upper end of the banknotes stored in the storage bag 100; a pressing member 80 that presses the banknotes stored in the storage bag 100; and a pushing film 52 that assists pushing of the banknotes by a pushing member 50 (see FIG. 8). These components will be described later.

As shown in FIG. 2, inner side walls of the storage mechanism 10 are connected to outer side walls of the mounting unit 20 by a plurality of slide rails 22 (22*a*, 22*b*). These rails 22 constitute a connecting member of the storage mechanism 10 and the mounting unit 20, but this configuration is an example of the connecting member. The configuration of the connecting member is not particularly limited as long as the mounting unit 20 is connected to the storage mechanism 10 such that the mounting unit 20 can be drawn out from inside of the storage mechanism 10. The rails 22*b* fixed to the mounting unit 20 slide with respect to the rails 22*a* fixed to the storage mechanism 10. This allows the mounting unit 20 to move between a position of the unit 20 drawn out from the apparatus 1 as shown in FIG. 2 and a position of the unit 20 in the apparatus 1 to store banknotes in the storage bag 100.

FIG. 2 shows an example of the mounting unit 20 having a box shape, but the shape of the mounting unit 20 is not particularly limited. An upper surface of the mounting unit 20 is open such that the storage bag 100 can be mounted and dismounted from the upper side of the mounting unit 20. This is an example of the mounting unit 20, and the configuration of the mounting unit 20 is not particularly limited as long as the storage bag 100 can be mounted to and dismounted from the mounting unit 20. For another example, the mounting unit 20 may have an opening on a lateral side such that the storage bag 100 is mounted and dismounted from the lateral side of the mounting unit 20. A holder mechanism including a pair of holders 30 (30*a*, 30*b*) for holding a part of the storage bag 100 near the opening portion of the storage bag 100 is disposed at an upper part of the mounting unit 20. For example, the holder 30*a* and the holder 30*b* are disposed facing each other. Preferably, the upper surfaces of the holder 30*a* and the holder 30*b* may be substantially horizontal. The position of the holder 30*a* is fixed. The holder 30*b*, disposed away in the horizontal direction (Y-axis direction) from the holder 30*a*, is movable in the Y-axis direction. A holder driving unit (not shown) drives the holder 30*b* to move.

A stage 40 is disposed beneath the holder 30. For example, the stage 40 includes a pair of opposing members 40*a*, 40*b* disposed facing each other. The configuration of the stage 40 is not particularly limited as long as a part of the storage bag 100 mounted to the mounting unit 20 can be placed on the stage 400 and supported by the stage 40. The pair of opposing members 40*a*, 40*b* are disposed such that a lower part of the storage bag 100 can be inserted between one member 40*a* and the other member 40*b*. Consequently, a part of the storage bag 100 is located between one member 40*a* and the other member 40*b*. For example, the pair of opposing members 40*a*, 40*b* are formed of a resin or a metal, but the material is not limited thereto. The pair of opposing members 40*a*, 40*b* are disposed facing each other, and one member 40*a* may preferably be disposed away from the other member 40*b* in the horizontal direction (Y-axis direction). Moreover, the stage 40 may preferably include the support member 40*c* that supports the pair of opposing members 40*a*, 40*b*. For example, the opposing members 40*a*, 40*b* each have a round-bar shape, but the shape of each member is not thereto. The opposing members 40*a*, 40*b* may not necessarily have the round-bar shape, and may have any shape as long as parts thereof being in contact with a bag body 102 have curved surfaces so as not to tear the bag body 102. Specifically, at least facing inner-side parts of the opposing members 40*a*, 40*b* may be curved in a cross section. A gap between the opposing members 40*a*, 40*b* is wider at both outer sides than at the center part. The pair of opposing members 40*a*, 40*b* disposed facing each other have: center parts having a gap of a constant width; and both outer-side parts that have a wider gap than the center parts and are connected to the center parts. Specifically, each of the opposing members 40*a*, 40*b* has: the center part parallel to the X-axis; expanding parts that are bent outward, in a horizontal plane (XY plane), at both outer sides with respect to the center part of a predetermined length such that the gap is gradually increased; and both end parts that are bent again in the opposite direction after the gap has been increased to a predetermined width so as to be parallel to the center part. For example, the opposing members 40*a*, 40*b* are formed such that the length, in the axial direction (X-axis direction), of the center part having the gap of the constant width is equal to or greater than ½ of the dimension of the long edge of the banknote supported by the stage 40. The width, in the Y-axis direction, of the gap between the center parts of the stage 40 is wider than the thickness of the bag body 102 that is folded such that at least a part of the bag body 102 can be inserted therein. The width of the gap between the center parts is adjusted to prevent a plurality of banknotes in a bundle form which are stored in the bag body 102 from falling below the stage 40 through the gap in the bag body 102. The stage 40 is movable in the up-down direction (Z-axis direction). A spring member (not shown) is attached to the support member 40*c* of the stage 40. The spring member energizes the stage 40 to move upward toward the holder 30. In addition, the position of the stage 40 can be controlled by a stage driving unit (not shown) that moves the support member 40*c* in the up-down direction. When the pushing member 50 pushes banknotes into the storage bag 100, the stage 40 is energized upward by the spring member. The stage driving unit controls the position of the stage 40 when detection of the upper end of the banknotes in the storage bag 100 is performed and when a frame 101 of the storage bag 100 is closed. The operation of the stage 40 will be described later in detail.

As indicated by an arrow in FIG. 2, the storage bag 100 is mounted from the upper opening portion of the mounting unit 20. The storage bag 100 includes the frame 101 and the bag body 102. The periphery of the opening portion of the bag body 102 is fixed to the side surfaces of the frame 101. Preferably, the entire periphery of the opening portion of the bag body 102 may be fixed to the entire four side surfaces of the frame 101. For example, the bag body 102 is adhered to the frame 101 by using an adhesive such that a banknote stored in the bag body 102 does not come out from interspace between the frame 101 and the bag body 102. Preferably, the frame 101 is formed of a hard material while the bag body 102 is formed of a soft material that is foldable, but materials of the frame 101 and bag body 102 are not particularly limited. For example, the frame 101 is formed of an opaque hard resin, and the bag body 102 is formed of opaque nylon. Banknotes transported by the transport unit 5 are fed into the storage mechanism 10 and stored inside of the bag body 102 of the storage bag 100.

The bag body 102 has a plurality of through-holes (not shown) having a diameter of a few millimeters. For example, if someone tries to break the banknote handling apparatus 1 and steal the storage bag 100, the banknote handling apparatus 1 detects this abnormality and sprays antitheft ink toward the storage bag 100. The sprayed ink enters the storage bag 100 through the through-holes and adheres to the banknotes. The adhered ink causes the banknotes to be identified as stolen banknotes.

When the storage bag 100 is mounted to the mounting unit 20, the bag body 102 is inserted in the gap between the two opposing members 40*a*, 40*b* of the stage 40 and the frame 101 is fixed to the holder 30. As shown in FIG. 2, the frame 101 has an opening portion 103. Banknotes pass through the opening portion 103 of the frame 101 and stored inside of the bag body 102. Preferably, the frame 101 may have a substantially rectangular opening portion 103, which is long in the longitudinal direction (X-axis direction), at substantially the center in the lateral direction (Y-axis direction). The frame 101 includes a gate for opening and closing the opening portion 103. Banknotes can pass through the opening portion 103 while the gate is open, but banknotes cannot pass through the opening portion 103 after the gate is closed. The operation of the door will be described later in detail.

When the mounting unit 20, to which the storage bag 100 has been mounted, is returned into the storage mechanism 10 and banknote handling is started, the storage mechanism 10 stacks banknotes 200 on the frame 101 as shown in FIG. 3. A plurality of banknotes 200 are stacked on the frame 101 in the stacking area in the storage mechanism 10. Preferably, the storage mechanism 10 may be provided with a plurality of stacking wheels 60, and a plurality of rollers 61, 62, for example. The rollers 61, 62 are disposed facing each other with outer circumferential surfaces thereof being in contact with each other. Each stacking wheel 60 has a plurality of blades disposed at equal angular intervals on an outer circumferential surface thereof. Preferably, the storage mechanism 10 may further include a pushing member 50 that pushes the banknotes 200 stacked on the frame 101 of the storage bag 100 into the bag body 102. The pushing member 50 is configured to move up-down direction. For example, the storage mechanism 10 includes a pantograph arm 51 that supports the pushing member 50 movably in the up-down direction. When a pushing member driving unit (not shown) drives the arm 51 to expand and contract in the up-down direction, the pushing member 50 moves in the up-down direction. The configuration for moving the pushing member 50 is not limited to the pantograph arm 51 as long as the pushing member 50 can move up-down direction. The pushing member 50 moves in the up-down direction between a retracted position shown in FIG. 3 and a pushing position at which the banknotes are pushed into the storage bag 100 (see FIG. 11), which will be described later in detail.

As shown in FIG. 3, the upper surface of the frame 101 mounted to the holder 30 composes a stacking area for stacking the banknotes 200 fed into the storage mechanism 10. This stacking area composes a boundary part of a stacking space in which the banknotes 200 are stacked. In other words, the banknotes 200 fed into the storage mechanism 10 are stacked in the stacking area, which composes a boundary part of the stacking space, on the upper surface of the frame 101 mounted to the holder 30 in the storage mechanism 10. The banknote handling apparatus 1 is configured to stack banknotes 200 transported by the transport unit 5 on the frame 101 used as the stacking area of the storage mechanism 10. Preferably, the banknote handling apparatus 1 may drive the rollers 61, 62 and the stacking wheels 60 to rotate, thereby stacking the banknotes 200 on the frame 101. As indicated by an arrow in FIG. 3, a banknote transported by the transport unit 5 passes between the rollers 61, 62 to enter the stacking space, and is sent onto the frame 101 by the stacking wheels 60. This is an example in which the storage mechanism 10 uses the rollers 61, 62 and the stacking wheels 60 to stack banknotes 200 in the stacking area on the frame 101, but the configuration of the storage mechanism 10 for stacking banknotes is not limited thereto.

The frame 101 has a shape that prevents the banknotes 200 from jumping out from the frame 101, i.e., from the stacking area. Specifically, as shown in FIG. 3, the frame 101 has a projection 101*c* that projects upward from the upper surface on which the banknotes 200 are stacked. The projection 101*c* is disposed at a position ahead in the moving direction of the banknote fed out by the stacking wheels 60. The projection 101*c* is in contact with at least a part of the side wall of the storage mechanism 10 to fill the gap between the frame 101 and the storage mechanism 10. Thus, even when a banknote, being transported at a high speed by the transport unit 5, is vigorously fed out in the X-axis positive direction by the stacking wheels 60, this banknote is prevented from jumping out through the gap between the storage mechanism 10 and the frame 101.

The upper surface of the frame 101 serves as a stacking surface, on which the banknotes 200 are stacked, in the stacking area of the storage mechanism 10. The upper surface of the frame 101 mounted to the holder 30 is substantially horizontal. As indicated by a broken line in FIG. 3, the banknotes 200 are stacked on the frame 101 with the faces thereof being parallel to the upper surface of the frame 101. When the number of the stacked banknotes 200 has reached a predetermined number (e.g., 10), the pushing member 50 moves downward and pushes the banknotes 200 into the bag body 102 through the opening portion 103 of the frame 101. The banknotes 201 in the bag body 102 are supported by the stage 40 from the lower outside of the bag body 102 such that the banknote faces are substantially horizontal. The pushing member 50 pushes the banknotes 200 from the upper side while the stage 40 supports the banknotes 201 from the lower side. This enables the plurality of banknotes 200, 201 to be stored in an aligned and stacked state in the bag body 102 formed of a deformable material. The position of the stage 40 energized upward by the spring member changes in the up-down direction according to the number of the banknotes stored in the bag body 102. When the banknotes 200 pushed by the pushing member 50 are added onto the banknotes 201 shown in FIG. 3, the stage 40 moves downward according to the number of the banknotes 200.

Figure 4A:
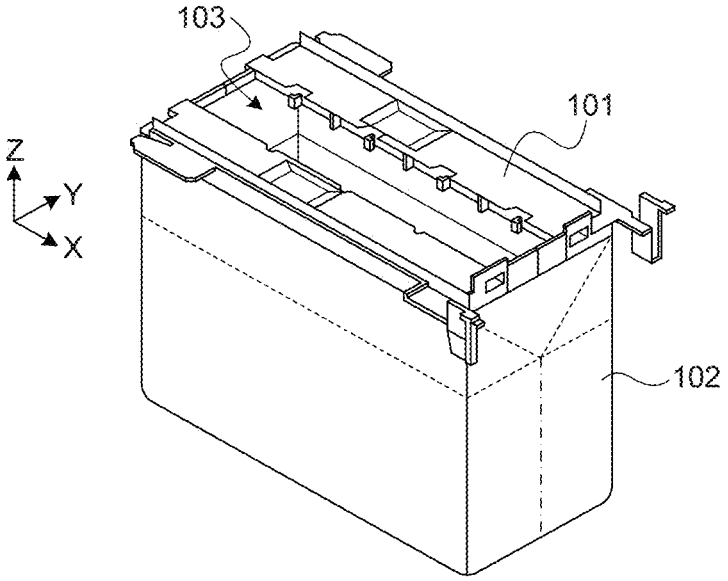
FIGS. 4A to 4C each illustrate a bag portion of the storage bag.
Figure 4B:
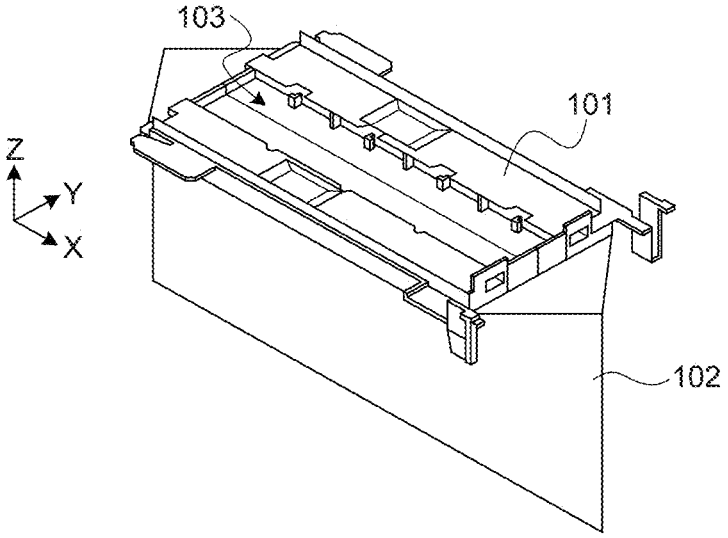
Figure 4C:
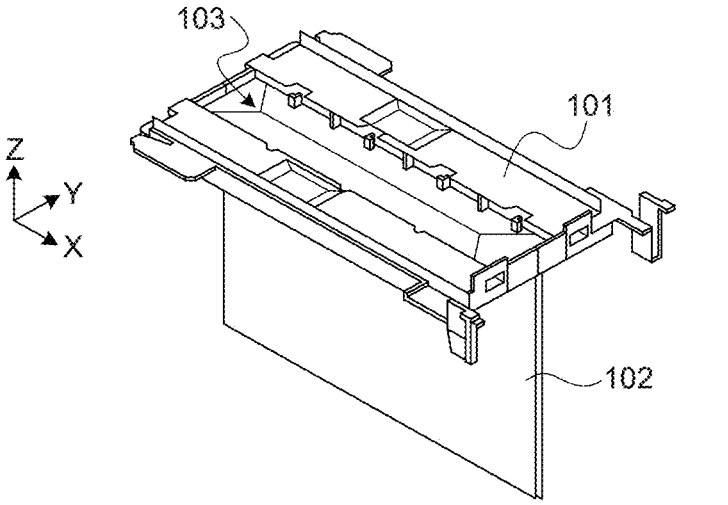

FIGS. 4A to 4C illustrate a bag portion of the storage bag 100. As shown in FIG. 4A, the bag body 102 has a substantially rectangular parallelepiped shape. The storage bag 100 can store several hundreds of banknotes, in a stacked state, which are pushed therein by the pushing member 50 through the opening portion 103 of the frame 101. Although the number of storable banknotes varies depending on the degree of damage of the banknotes, the storage bag 100 can store therein 400 to 600 banknotes, for example.

The bag body 102 before use is folded as shown in FIG. 4B or 4C. For example, the bag body 102 is folded at a position indicated by a broken line shown in FIG. 4A. When the bag body 102 is folded such that a substantially center part on a lateral side surface of the bag body 102 indicated by an alternate long and short dash line shown in FIG. 4A protrudes outward, the bag body 102 is folded as shown in FIG. 4B. Alternatively, when the bag body 102 is folded such that the part indicated by the alternate long and short dash line shown in FIG. 4A protrudes inward, the bag body 102 is folded as shown in FIG. 4C. Since a lower part of the bag body 102 is made flat by folding the bag body 102 as shown in FIG. 4B or FIG. 4C, the bag body 102 can be inserted easily into the gap between the two opposing members 40*a*, 40*b* of the stage 40 shown in FIG. 2. Even when the length, in the X-axis direction, of the bag body 102 folded as shown in FIG. 4B is longer than the length of the stage 40 in the X-axis direction shown in FIG. 2, since the gaps between the opposing members 40*a*, 40*b* at the both outer sides are wide, both outer parts of the bag body 102 can be easily inserted in these gaps. The flat shape of the folded bag body 102 is realized by folding at least a part of the bag body 102, which can form a banknote storage space as shown in FIG. 4A, so as to make a lower part of the bag body 102 flat and reduce the banknote storage space. The lower part of the bag body 102 may not necessarily be completely flat as long as the lower part can be inserted in the gap between the two opposing members 40*a*, 40*b* of the stage 40. A part of the bag body 102 may inflate and/or may form a curved surface.

Figure 5A:
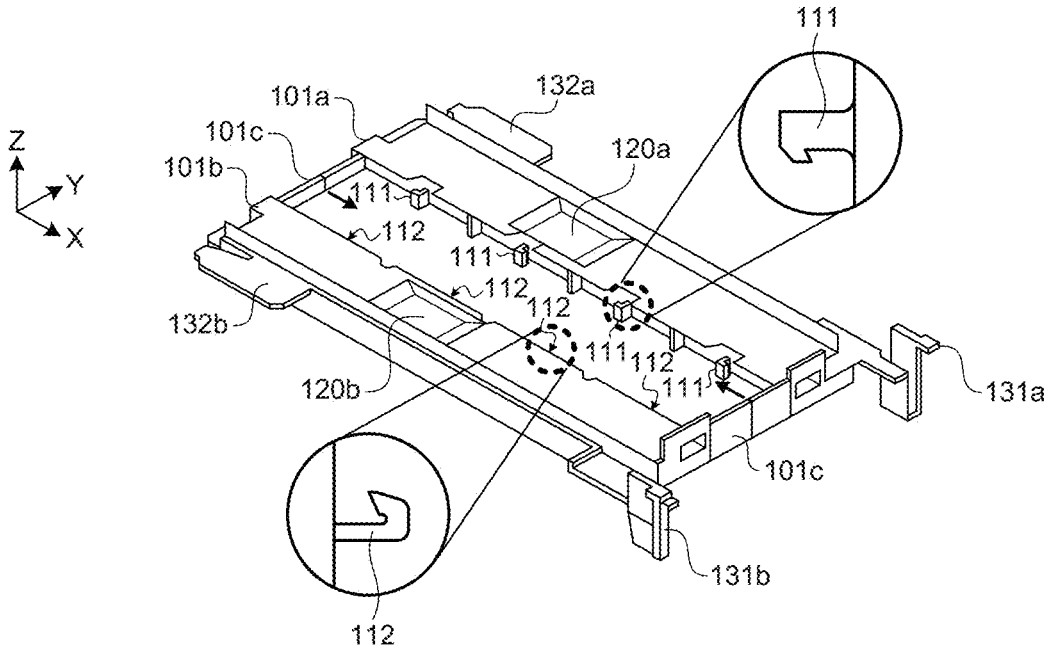
FIGS. 5A and 5B each illustrate a frame of the storage bag.
Figure 5B:
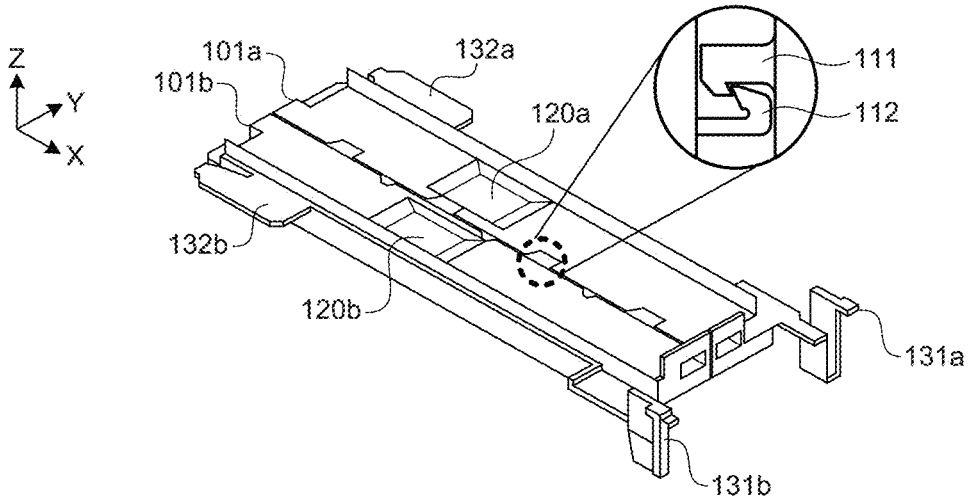

FIGS. 5A and 5B illustrate the frame 101 of the storage bag 100. Although the bag body 102 is not shown in FIGS. 5A and 5B, the opening portion of the bag body 102 is fixed to the side surfaces of the frame 101 by using an adhesive. FIG. 5A shows a state where the opening portion 103 of the frame 101 is open, and FIG. 5B shows a state where the opening portion 103 of the frame 101 is closed. When the opening portion 103 is open as shown in FIG. 5A, the opening portion of the storage bag 100 is also open. In the open state shown in FIG. 5A, banknotes can be stacked onto the frame 101, and the stacked banknotes can be stored in the bag body 102 by being pushed into the bag body 102 from the opening portion 103 of the frame 101.

As shown in FIG. 5A, the frame 101 includes a pair of frame members 101*a*, 101*b* disposed facing each other. The pair of frame members 101*a*, 101*b* function as the above-mentioned gate. The pair of frame members 101*a*, 101*b* forming the gate are separated each other when the opening portion 103 of the frame 101 is open, i.e., the opening portion of the storage bag 100 is open. The pair of frame members 101*a*, 101*b* forming the gate move and come into contact each other to close the opening portion 103 of the frame 101. The opening portion of the storage bag 100 is closed by closing the opening portion 103 of the frame 101. Preferably, the frame 101 may further include connection members 101*c* connecting longitudinal-side opposed ends of the respective frame members 101*a*, 101*b*. Each connection member 101*c* is bendable in a direction indicated by an arrow in FIG. 5A. When at least one of the frame member 101*a* and the frame member 101*b* is moved in the Y-axis direction, the connection members 101*c* bend and substantially center parts thereof move toward the inside of the frame 101 as indicated by arrows in FIG. 5A, whereby the opening portion 103 of the frame 101 can be closed as shown in FIG. 5B.

The opening portion 103 is formed by a plurality of members 101*a*, 101*b*, 101*c*. As shown in enlarged views in FIG. 5A, on the longitudinal side surface of the frame member 101*a* facing the frame member 101*b*, a plurality of hook-shaped connecting portions 111 are disposed. Meanwhile, on the longitudinal side surface of the frame member 101*b* facing the frame member 101*a*, a plurality of hook-shaped connecting portions 112 are disposed so as to correspond to the connecting portions 111. A connecting portion 111 and a corresponding connecting portion 112 form a pair, and a plurality of pairs are disposed at unequal intervals in the longitudinal direction. For example, the number of connecting portions 111, 112 disposed at both outer sides is larger than the number of the portions 111, 112 at the center in the longitudinal direction so that the connecting portions 111 are not disconnected from the corresponding connecting portions 112 when twisting force is applied to the frame member 101*a* and the frame member 101*b* of the gate that has closed the opening portion 103.

The hook-shaped projection formed at an end of a shaft part of each connecting portion 111 and the hook-shaped projection formed at an end of a shaft part of each connecting portion 112 are engaged with each other as shown in an enlarged view in FIG. 5B when the opening portion 103 is closed by closing the gate. The shaft part of the connecting portion 111 is thicker than the shaft part of the connecting portion 112. During a process of closing the opening portion 103, the connecting portion 112 elastically deforms and bows outward while the projection of the connecting portion 112 passes through the position of the projection of the connecting portion 111. The connecting portion 112 returns to the original shape after having passed through the position of the projection of the connecting portion 111, whereby the projection of the connecting portion 112 is engaged with the projection of the connecting portion 111. As shown in FIG. 5B, the engagement of the connecting portion 111 and the connecting portion 112 causes the frame member 101*a* and the frame member 101*b* to be fixed with the opening portion 103 being closed. When the opening portion 103 is closed, the connecting portions 111, 112 are hidden behind the frame 101 and are not visible from the outside of the storage bag 100.

Conventionally, for the purpose of closing the opening portion 103 of the frame 101, a configuration in which a shaft having an umbrella-shaped tip is pushed into a hole having a diameter smaller than that of the umbrella-shaped part, has been adopted. In this configuration, when the process of closing the opening portion 103 of the frame 101 is to be automated, great driving force for pushing the umbrella-shaped tip into the hole is required. With the configuration shown in FIG. 5, the process of closing the opening portion 103 of the frame 101 can be automated more easily with less driving force as compared to the conventional configuration.

After the projections of the connecting portions 111 are engaged with the projections of the connecting portions 112, the opening portion 103 of the frame 101 cannot be opened. If the once closed opening portion 103 of frame 101 is forcibly opened, the connecting portions 112, which have the thinner shaft parts than the connecting portions 111 and whose projections are engaged with the projections of the connecting portions 111, are broken. The broken connecting portions 112 fall into the bag body 102. After banknotes are stored in the storage bag 100, the opening portion 103 of the frame 101 is closed, and the storage bag 100 with the closed frame 101 is collected from the banknote handling apparatus 1. For example, the collected storage bag 100 is carried to a financial institution. In the financial institution, the bag body 102 is torn and the banknotes are taken out from the storage bag 100 without opening the opening portion 103 of the frame 101. Therefore, if the opening portion 103 of the frame 101 was opened (or attempted to be opened) after the banknote handling apparatus 1 closed the opening portion 103 of the frame 101, it can be found according to whether or not broken connecting portions 112 are present in the torn bag body 102.

Figure 6:
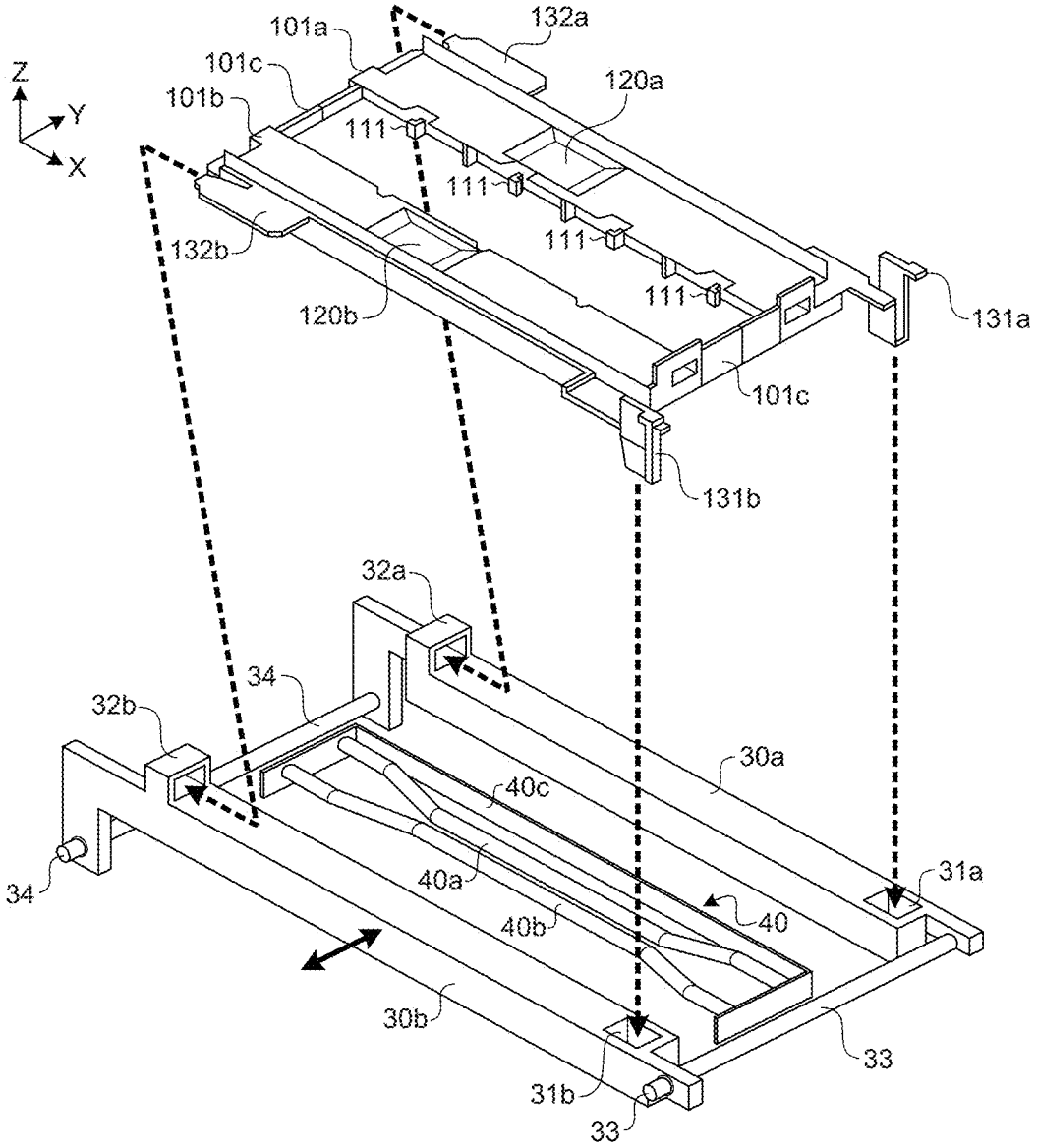
FIG. 6 illustrates a method for mounting and dismounting the storage bag to a holder.

FIG. 6 illustrates a method for mounting and dismounting the storage bag 100. In FIG. 6, illustration of the bag body 102 is omitted. The frame 101 has a plurality of insertion portions 131 (131*a*, 131*b*) and 132 (132*a*, 132*b*). Some insertion portions 131 have a plate spring shape with a projection that allows snap-fit mounting/dismounting.

An insertion portion 132*a* insertable in a hole formed substantially in the horizontal direction (X-axis direction) is disposed at one end of the longitudinal side surface of the frame member 101*a* of the frame 101, and an insertion portion 131*a* for snap-fit to be inserted in a hole formed substantially in the vertical direction (Z-axis direction) is disposed at the other end of the frame member 101*a*. Likewise, an insertion portion 132*b* insertable in a hole formed substantially in the horizontal direction is disposed at one end of the longitudinal side surface of the frame member 101*b*, and an insertion portion 131*b* for snap-fit to be inserted in a hole formed substantially in the vertical direction is disposed at the other end of the frame member 101*b*. In the holder 30, holes 32 (32*a*, 32*b*) corresponding to the respective insertion portions 132 are formed substantially in the horizontal direction, and holes 31 (31*a*, 31*b*) for snap-fit corresponding to the respective insertion portions 131 are formed substantially in the vertical direction.

Each hole 31 formed in the holder 30 has a dimension that conforms with deformation of the corresponding plate-spring-shaped insertion portion 131. A groove for engaging with the projection of the insertion portion 131 is formed inside the hole 31. When the insertion portion 131 is inserted in the hole 31, the plate-spring-shaped insertion portion 131 elastically deforms in the Y-axis direction. Then, the shape of the insertion portion 131 is restored at a position where the projection of the insertion portion 131 is fitted in the groove inside the hole 31, whereby the position of the insertion portion 131 is fixed with respect to the hole 31. When force is applied to the plate-spring-shaped insertion portion 131 so as to release the projection of the insertion portion 131 from the groove inside the hole 31 and to pull the insertion portion 131 upward, the projection is removed from the groove and the insertion portion 131 can be pulled out from the hole 31.

Figure 7A:
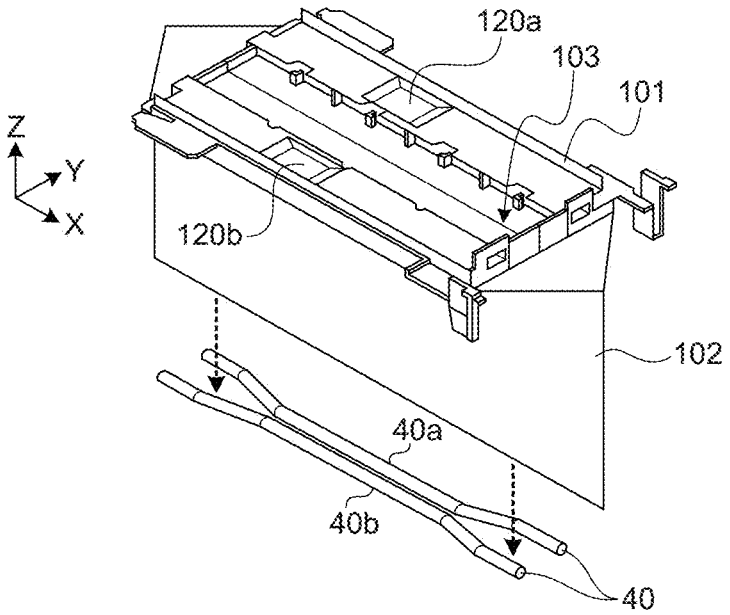
FIGS. 7A to 7C illustrate stacking and storage of banknotes.

Although the bag body 102 is not shown in FIG. 6, a folded bag body 102 is inserted in the gap between the two opposing members 40*a*, 40*b* of the stage 40 (see FIG. 7A). As indicated by broken-line arrows in FIG. 6, the two insertion portions 132 of the frame 101 are substantially horizontally inserted into the corresponding holes 32 of the holder 30 obliquely from the upper side, and thereafter, the two insertion portions 131 for snap-fit are inserted into the corresponding holes 31 of the holder 30, whereby the storage bag 100 is mounted to the holder 30. The frame 101 is fixed to the holder 30 such that the upper surface of the frame member 101*a* and the upper surface of the frame member 101*b* are flush with each other to form a substantially horizontal flat surface. Since a plurality of the holes 31, 32 and the corresponding insertion portions 131, 132 are formed in different insertion directions, the frame 101 can be fixed at the predetermined position of the holder 30. Since the insertion portion 132 present at the front side (the X-axis negative direction) of the frame 101 is substantially horizontally inserted in the hole 32 present at the front side of the holder 30 while the insertion portion 131 present at the rear side of the frame 101 is substantially vertically inserted in the hole 31 present at the rear side of the holder 30, a user can easily mount the frame 101 to the holder 30 with one hand.

The holder 30*a* and two shafts 33, 34 shown in FIG. 6 are disposed such that the positions thereof are fixed with respect to the mounting unit 20. The two shafts 33, 34 are respectively inserted through through-holes formed in the holder 30*b*. The holder 30*b* is driven by a holder driving unit (not shown) to move in parallel along the shafts 33, 34 as indicated by a solid-line arrow shown in FIG. 6. One holder 30*b* moves toward the other holder 30*a* with the frame 101 being mounted thereto. Thus, as shown in FIG. 5, the connecting portions 111 of the frame member 101*a* are connected to the connecting portions 112 of the frame member 101*b*, whereby the opening portion 103 of the frame 101 can be closed. The opening portion of the storage bag 100 is closed by closing the opening portion 103 of the frame 101.

After the opening portion of the storage bag 100 is closed, the storage bag 100 can be removed from the holder 30 through a procedure opposite to the mounting of the frame 101 to the holder 30. Specifically, the two insertion portions 131 are held from outside by one hand to release engagement of snap-fit, and the insertion portions 131 are pulled out upward from the holes 31. Furthermore, the insertion portions 132 are pulled out rearward (X-axis positive direction) from the holes 32. Thus the frame 101 can be removed from the holder 30.

Figure 7B:
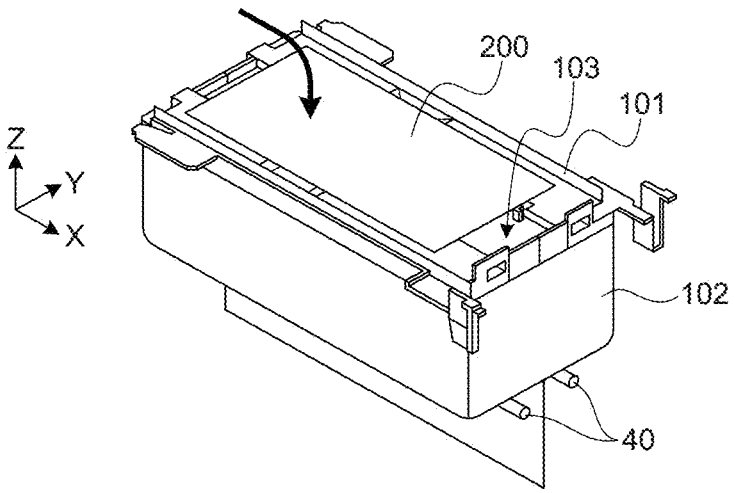
Figure 7C:
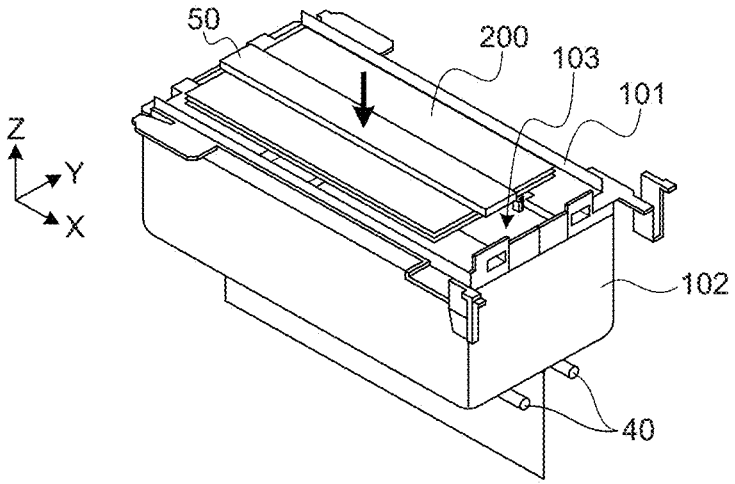

FIGS. 7A to 7C illustrate stacking and storage of banknotes. In FIGS. 7A to 7C, illustration of some components including the holder 30 is omitted. An unused folded bag body 102 is inserted in a gap between the two opposing members 40*a*, 40*b* of the stage 40 as shown in FIG. 7A, and the frame 101 is fixed to the holder 30 as described with reference to FIG. 6. As shown in FIG. 7B, banknotes 200 are stacked on the upper surface of the frame 101 fixed to the holder 30. As shown in FIG. 7C, the banknotes 200 stacked on the frame 101 are pushed by the pushing member 50 into the storage bag 100 through the opening portion 103 of the frame 101 and are stored inside the storage bag 100. The opening portion 103 of the frame 101 is formed such that, even when the banknotes 200 are shifted to one side in the short edge direction, one long edge of the banknotes 200 is located on the frame member 101*a* of the frame 101 while the other long edge of the banknotes 200 is located on the frame member 101*b*. That is, the opening portion 103 is formed while the position and the size thereof are adjusted such that, both the two long edges of a banknote 200 stacked on the frame 101 are in contact with the upper surface of the frame 101.

As shown in FIG. 7A, the bag body 102 of the storage bag 100, in which no banknotes are stored, is folded. When the pushing member 50 pushes the banknotes 200 on the frame 101 into the bag body 102 through the opening portion 103, folded portions of the bag body 102 are unfolded and the bag body 102 is expanded, whereby a banknote storage space for storing pushed banknotes in the bag body 102 is formed beneath the frame 101 and above the stage 40. Since the gap of the stage 40 is wide at the both outer sides, the folded portions of the bag body 102 can be easily unfolded at these wide gaps. The storage mechanism 10 repeats the banknote stacking process shown in FIG. 7B and the banknote pushing process shown in FIG. 7C. According to the number of banknotes stored in the bag body 102, the folded bag body 102 gradually expands downward to increase the banknote storage space formed inside of the bag body 102 for storing banknotes. The stage 40 moves downward as the storage space is increased.

As shown in FIG. 7A, a plurality of detection areas 120 (120*a*, 120*b*) to receive and reflect detection light are provided on the upper surface of the frame 101. Specifically, a detection area 120*a* is provided on the upper surface of the frame member 101*a* while a detection area 120*b* is provided on the upper surface of the frame member 101*b*. The detection areas 120*a*, 120*b* are formed by attaching mirror-finished flat members to the frame members 101*a*, 101*b*. The storage mechanism 10 is provided with sensors (not shown) corresponding to the detection areas 120*a*, 120*b*, respectively. Each sensor irradiates the corresponding detection area 120 with detection light emitted from a light emitter, and receives the detection light reflected from the detection area 120 by a light receiver. When no banknote is present on the frame 101 as shown in FIG. 7A, the detection light is reflected from the whole detection area 120. When the banknotes 200 are stacked on the upper surface of the frame 101 as shown in FIG. 7B, at least a part of the detection area 120 is covered with the banknotes 200, and the intensity of reflected light of the detection light changes. The banknote handling apparatus 1 detects presence/absence of banknotes 200 on the frame 101, based on the change in the detection light. For example, if a banknote is left on the frame 101 after the pushing process to store banknotes into the storage bag 100, the banknote handling apparatus 1 detects this banknote by the sensors and executes the pushing process again to store this banknote into the storage bag 100.

Figure 8:
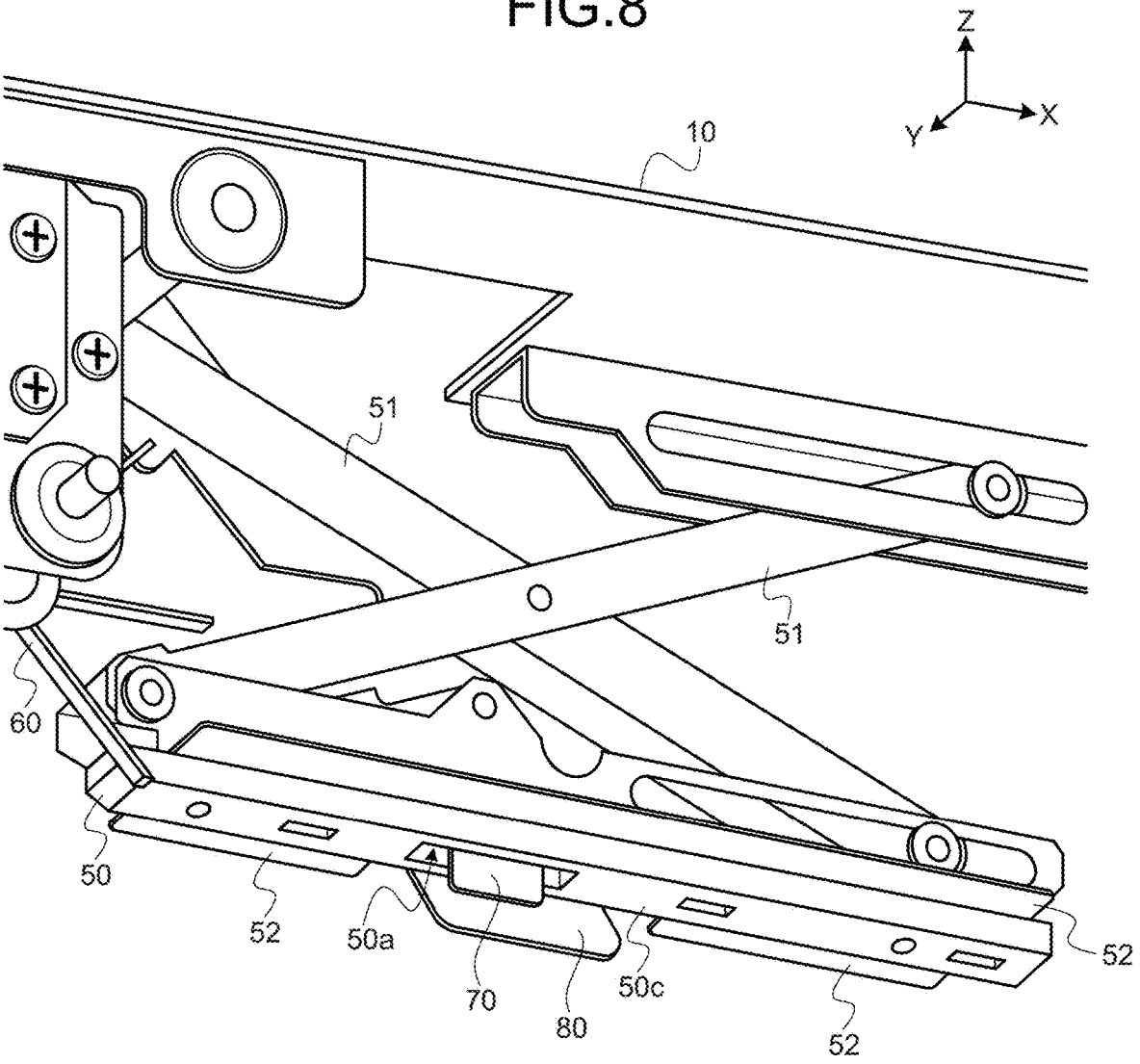
FIG. 8 illustrates a part of the storage mechanism.

FIG. 8 shows a part of the storage mechanism 10. Preferably, as shown in FIG. 8, a pushing film 52 may be disposed on a longitudinal side surface of the pushing member 50. The pushing film 52 is a member for assisting the pushing process by the pushing member 50, which will be described later in detail.

The banknote handling apparatus 1 closes the opening portion 103 of the frame 101 of the storage bag 100 by closing the gate of the frame 101 when the number of banknotes stored in the storage bag 100 has reached a predetermined upper limit. The opening portion of the storage bag 100 is closed by closing the opening portion 103 of the frame 101. Even when the number of banknotes stored in the storage bag 100 has not reached the upper limit, the banknote handling apparatus 1 closes the opening portion of the storage bag 100 if an upper end of the stored banknotes has reached a predetermined position in the storage bag 100.

As shown in FIG. 8, the storage mechanism 10 includes a detection member 70 for detecting the upper end of banknotes stored in the storage bag 100. For example, the detection member 70 is a lever having a thin plate shape. The pushing member 50 has a through-hole 50*a* formed at the position corresponding to the detection member 70. The detection member 70 having a thin plate shape is disposed at substantially the center of the through-hole 50*a* in the lateral direction (Y-axis direction) of the pushing member 50. When the pushing member 50 is at the retracted position above the stacking area as shown in FIG. 3, the detection member 70 is retracted inside the through-hole 50*a* of the pushing member 50. When the pushing member 50 moves from the retracted position to the pushing position, the detection member 70 comes out from the through-hole 50*a*.

Preferably, the storage mechanism 10 may further include a pressing member 80 for pressing banknotes stored in the storage bag 100. For example, the pressing member 80 is a lever having a thin plate shape, but the shape of the pressing member 80 is not limited thereto. For example, the pressing member 80 is disposed outside of the lateral side surface of the pushing member 50, but the position of the pressing member 80 is not limited thereto. While the gate of the frame 101 of the storage bag 100 is moving to close the opening portion 103 of the frame 101, the banknotes being stored in the storage bag 100 are being pressed downward from above by the pressing member so as not to be sandwiched between the two frame members 101*a*, 101*b* of the frame 101.

Figure 9:
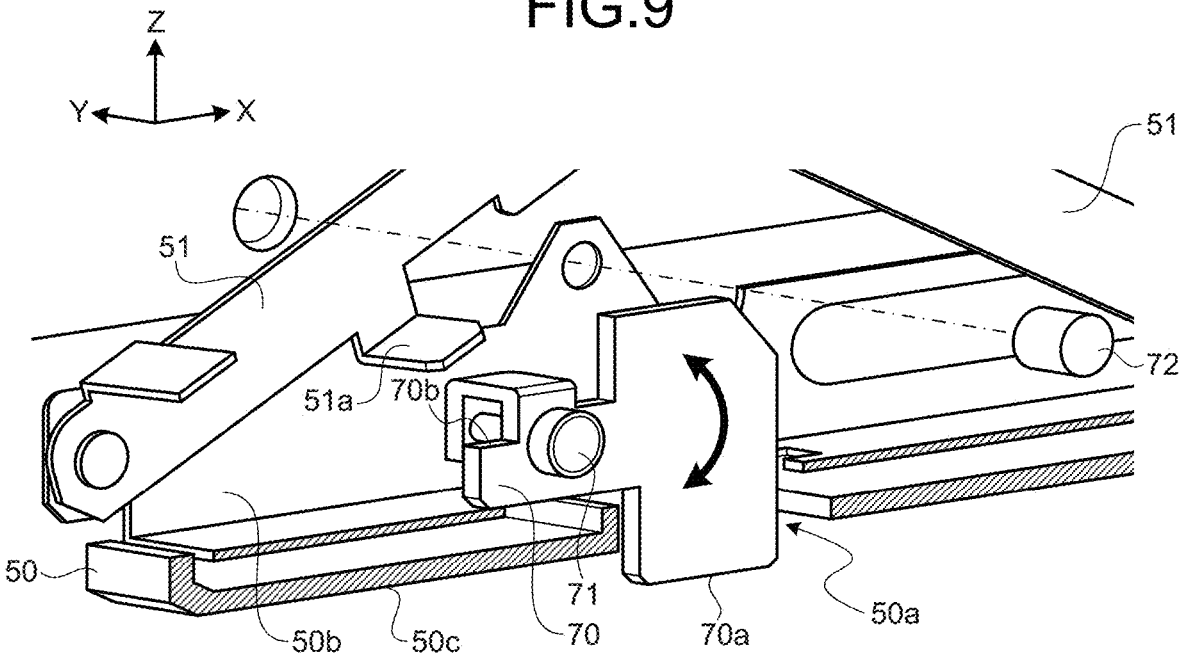
FIG. 9 illustrates a detection member.

FIG. 9 illustrates an example of the detection member 70. The configuration of the detection member 70 is not particularly limited as long as the detection member 70 can be used for detecting whether or not the upper end of the banknotes being stored in the storage bag 100 has reached the predetermined position. In FIG. 9, the pushing member 50 is shown in its cross section. As shown in FIG. 9, a shaft 71 having an axis along the Y-axis direction is fixed to the frame 50*b* of the pushing member 50. The detection member 70 is pivotable around the shaft 71 as indicated by an arrow in FIG. 9.

FIG. 9 shows a state where the pushing member 50 is present at a detection position between the retracted position where the pushing member 50 is present above the frame 101 of the storage bag 100 and the pushing position where the pushing member 50 is present beneath the frame 101 of the storage bag 100. While the pushing member 50 is at the detection position, the banknote handling apparatus 1 detects whether or not the upper end of the banknotes being stored in the storage bag 100 has reached the predetermined position by using the detection member 70.

As shown in FIG. 9, when the pushing member 50 is at the detection position, a storage claw 51*a* formed on the arm 51 is away from the detection member 70, and the detection member 70 can freely pivot within a predetermined range around the shaft 71. When no banknote is in contact with the detection member 70, a part of the detection member 70 is in contact with a part of the pushing member 50 as shown in FIG. 9. Thus, the detection member 70 stops at a predetermined position where a lower surface (detection surface) 70*a* for detecting a banknote becomes parallel to a lower surface (pushing surface) 50*c* of the pushing member 50.

A sensor 72 which emits and receives detection light is disposed such that the detection light passes through a position above the detection member 70 when no banknote is in contact with the detection member 70, as shown by an alternate long and short dash line in FIG. 9. When the upper end of the banknotes stored in the storage bag 100 has reached the predetermined position, the banknotes push the detection member 70 upward. As a result, the detection member 70 pivots counterclockwise around the shaft 71 and blocks the detection light of the sensor 72. The banknote handling apparatus 1 detects whether or not the upper end of the banknotes stored in the storage bag 100 has reached the predetermined position, based on change between transmission and blocking of the detection light.

When the pushing member 50 moves from the detection position shown in FIG. 9 to the retracted position above the detection position, the storage claw 51*a* formed on the arm 51 comes into contact with a back surface portion 70*b* of the detection member 70. The detection member 70, whose back surface portion 70*b* is pressed downward by the storage claw 51*a*, pivots counterclockwise around the shaft 71 and is retracted inside the pushing member 50.

Figure 10:
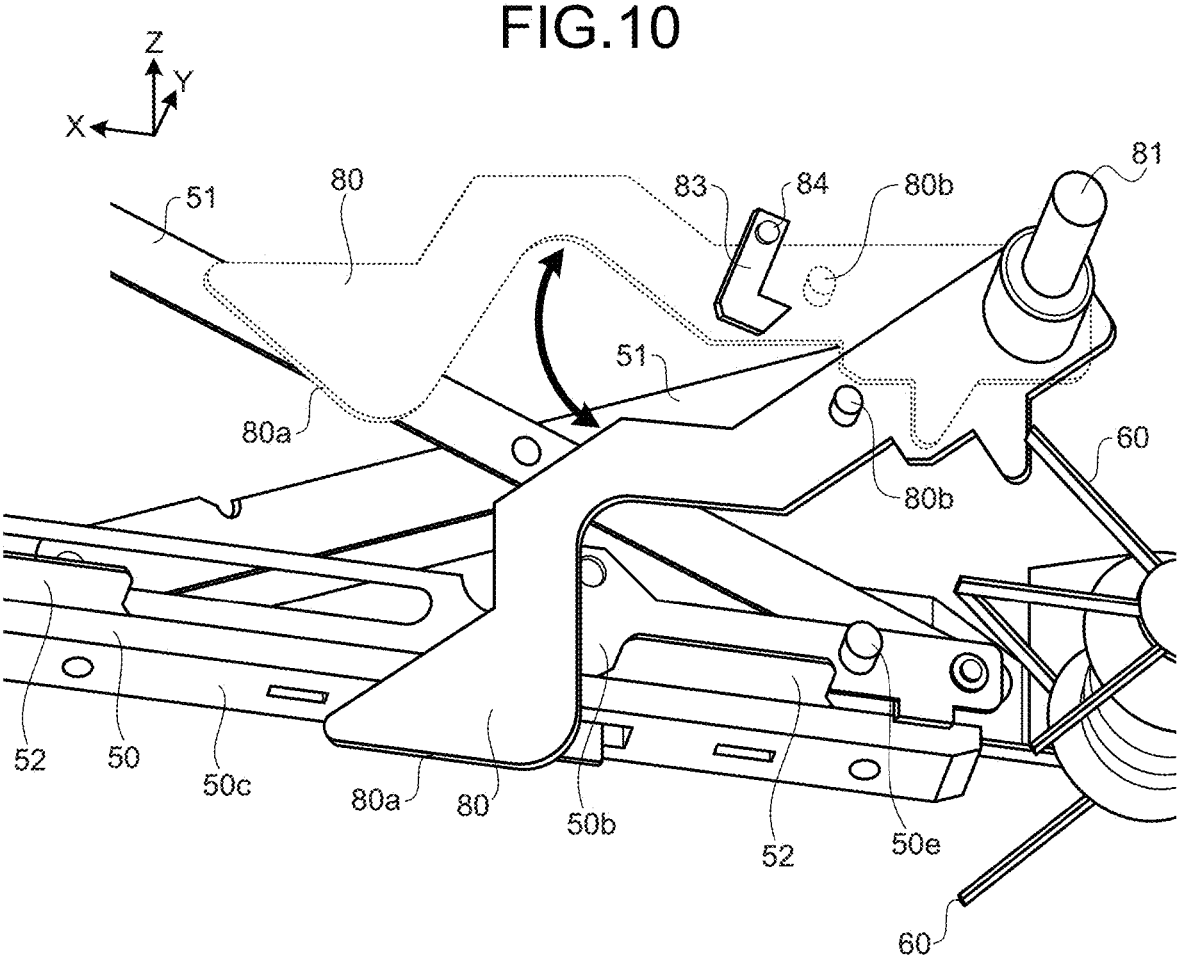
FIG. 10 illustrates a pressing member.

FIG. 10 illustrates an example of the pressing member 80. The configuration of the pressing member 80 is not particularly limited as long as the pressing member 80 can be used for pressing the banknotes being stored in the storage bag 100. FIG. 10, the pressing member 80 released from the locking member 83 is indicated by a solid line. A broken line indicates a position of the pressing member 80 locked by the locking member 83.

As shown in FIG. 10, a shaft 81 having an axis along the Y-axis direction is fixed to the storage mechanism 10. The pressing member 80 is pivotable around the shaft 81 as indicated by an arrow in FIG. 10. The pressing member 80 is energized downward by an energizing member (not shown). Preferably, the energizing member may consist of an elastic member. More preferably, the energizing member may consist of a spring member. For example, the pressing member 80 is energized by the spring member in a counterclockwise direction around the shaft 81.

The pressing member 80 having been released from the locking member 83 is energized by the spring member and pivots in the counterclockwise direction around the shaft 81. When the pressing member 80 energized by the spring member pivots around the shaft 81, a part of the pressing member 80 comes into contact with a part of the storage mechanism 10, whereby the pressing member 80 stops at the predetermined position indicated by the solid line in FIG. 10. The pressing member 80 stops at the position where a lower surface (pressing surface) 80*a* is parallel to the pushing surface 50*c* of the pushing member 50.

When the pushing member 50 moves upward from the position shown in FIG. 10, a storage pin 50*e* formed on the frame 50*b* of the pushing member 50 also moves upward. While the storage pin 50*e* is away from the pressing member 80, the pressing member 80 stops at the position to press banknotes. After the pushing member 50 has moved upward and the storage pin 50*e* has come into contact with the pressing member 80, the pressing member 80 is pushed upward by the storage pin 50*e* as the pushing member 50 further moves upward. When the pressing member 80 has been pushed upward to the position indicated by the broken line in FIG. 10, the locking member 83 locks the pressing member 80.

The locking member 83 having an L shape is pivotable around a shaft 84 having an axis along the Y-axis direction and fixed to the storage mechanism 10. A driving unit (not shown) drives the locking member 83 to pivot around the shaft 84. The locking member 83 pivots counterclockwise from the position shown in FIG. 10, and is engaged with a pin 80*b* of the pressing member 80 indicated by the broken line, thereby locking the pressing member 80. The banknote handling apparatus 1 can repeat the pushing process of pushing banknotes stacked on the frame 101 into the storage bag 100 by moving the pushing member 50 in the up-down direction while the pressing member 80 being locked by the locking member 83. When the opening portion of the storage bag 100 is to be closed, the banknote handling apparatus 1 releases the pressing member 80 from the locking member 83. The released pressing member 80 energized by the spring member pivots downward to the position indicated by the solid line in FIG. 10, and presses the banknotes.

Next, the pushing process will be described. In the pushing process, the banknote handling apparatus 1 pushes, by using the pushing member 50, banknotes 200 stacked on the frame 101 into the storage bag 100. FIGS. 11A to 11D are schematic diagrams illustrating the pushing process.

Figure 11A:
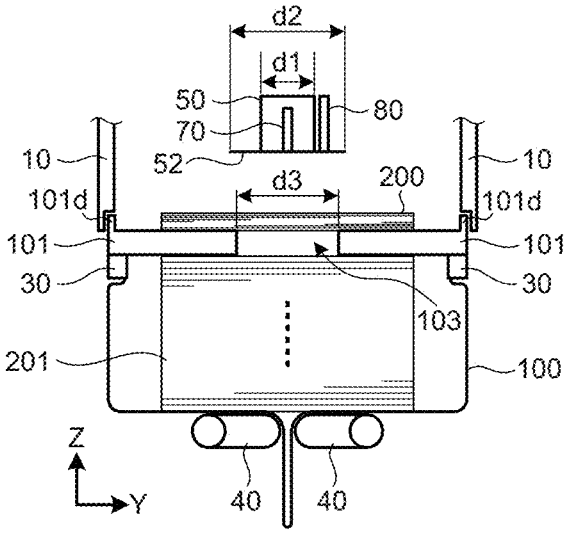
FIGS. 11A to 11D are schematic diagrams illustrating a pushing process.

FIG. 11A shows a step in which the banknotes 200 transported by the transport unit 5 are stacked onto the frame 101. In this step, the pushing member 50 is present at the retracted position above the frame 101 so as not to interfere with movement of banknotes to be stacked on the frame 101. The banknote handling apparatus 1 stacks the banknotes 200 transported by the transport unit 5, one by one, onto the frame 101 of the storage bag 100 mounted to the holder 30.

A width d3 of the opening portion 103 shown in FIG. 11A is smaller than the width (short edge dimension) of the banknotes 200 stacked on the upper surface of the frame 101. The opening portion 103 is formed such that the left end of the banknotes 200 is away from the left end of the opening portion 103 even when the banknotes 200 are stacked on the rightmost side on the frame 101, and the right end of the banknotes 200 is away from the right end of the opening portion 103 even when the banknotes 200 are stacked on the leftmost side on the frame 101. Thus, the banknotes 200 fed into the stacking area by the stacking wheels 60 are reliably stacked on the frame 101, and do not fall into the storage bag 100 through the opening portion 103 unless the banknotes 200 are pushed by the pushing member 50.

As shown in FIG. 11A, at the both ends of the frame 101 in the lateral direction, projections 101*d* are formed so as to project upward from the upper surface of the frame 101 on which the banknotes 200 are stacked. The projections 101*d* are formed along the longitudinal side surface of the frame 101. Since each projection 101*d* is in contact with at least a part of the side wall of the storage mechanism 10 to fill the gaps between the frame 101 and the storage mechanism 10, the banknotes 200 are prevented from jumping out through the gaps between the storage mechanism 10 and the frame 101.

The stage 40 is energized upward by the spring member. Therefore, the banknotes 201 stored inside the storage bag 100 are pushed upward by the stage 40 and are pressed against the lower surface of the frame 101 as shown in FIG. 11A. Since the banknotes 201 stored in the storage bag 100 are compressed in the up-down direction while being sandwiched via the storage bag 100 between the upper surface of the stage 40 and the lower surface of the frame 101, the aligned state of the banknotes 201 is maintained.

A width d1 indicates a width of the pushing surface of the pushing member 50 that contacts with the upper surface of the banknote when the pushing member 50 pushes the banknote in the pushing process. The width d1 is smaller than the width d3 of the opening portion 103 (d1<d3). The pushing member 50 is movable in the up-down direction at a substantially center position in the width direction of the opening portion 103. Preferably, the pushing film 52 may be attached to the lower end of the pushing member 50. The pushing film 52 is formed of a thin resin material that is elastically deformable. For example, a polyester film having a thickness of about several hundred μm is used as the pushing film 52. Both outer edges of the pushing film 52 in the width direction (Y-axis direction) are positioned outside of the opening portion 103. When the pushing member 50 passes through the opening portion 103, the pushing member 50 can pass through the opening portion 103 because the pushing film 52 is elastically deformable.

As shown in FIG. 11A, a width d2 of the pushing film 52, i.e., a distance d2 between the both outer edges of the pushing film 52, is greater than the width d3 of the opening portion 103 (d2>d3). For example, the width d1 is about 15 mm, the width d2 is about 40 mm, and the width d3 is about 30 mm.

Figure 11B:
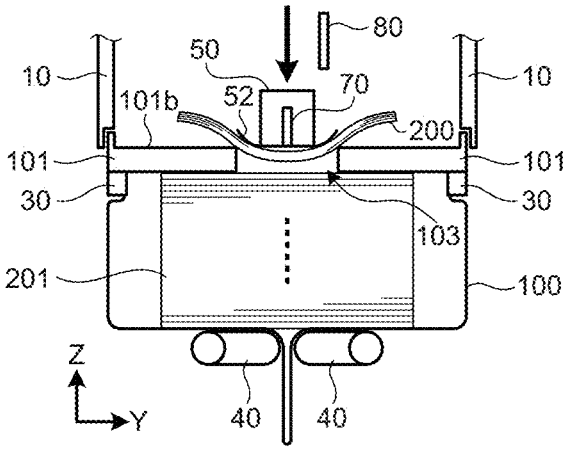

When the number of the banknotes 200 stacked on the frame 101 has reached a predetermined number (e.g., 10), the banknote handling apparatus 1 suspends stacking of banknotes onto the frame 101, and pushes the stacked banknotes 200 into the storage bag 100 to store the banknotes 200 in the storage bag 100 by the pushing member 50. As shown in FIG. 11B, the banknote handling apparatus 1 moves the pushing member 50 downward from the retracted position. The pushing member 50 moving downward pushes the banknotes 200 into the opening portion 103 of the opened gate. The banknotes are bent while passing the opening portion 103. In this step, the pushing film 52 passes through the opening portion 103 of the opened gate. The pushing file 52 is elastically deformed such that the both outer edges of the pushing film 52 warp upward while passing the opening portion 103.

The both outer edges of the pushing film 52 come into contact with the inner wall of the opening portion 103 if there is no banknote. That is, the pushing film 52 is formed to fill the gap between the pushing member 50 and the frame 101 when the pushing member 50 passes through the opening portion 103 of the opened gate. Thus, when the pushing member 50 pushes the banknotes 200 through the opening portion 103 of the opened gate as shown in FIG. 11B, the banknotes 200 are reliably pushed into the storage bag 100.

Figure 11C:
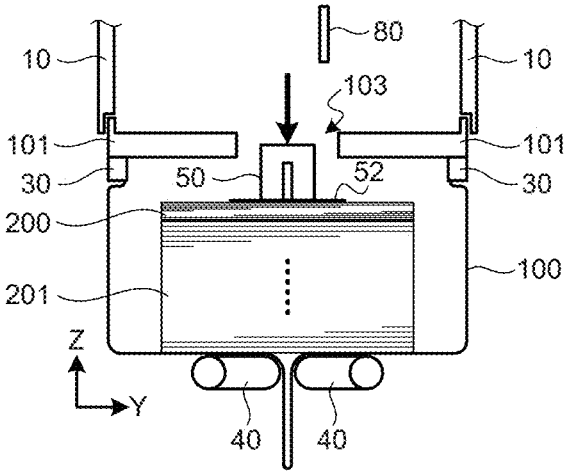
Figure 11D:
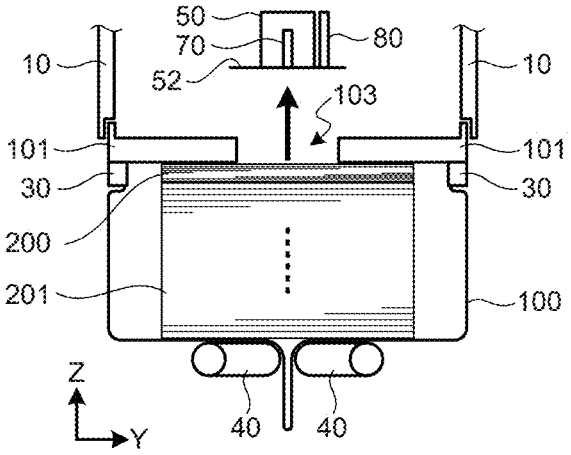

As shown in FIG. 11C, the pushing member 50 moves to the pushing position a predetermined distance beneath the lower surface of the frame 101. The banknotes 200 pushed into the storage bag 100 by the pushing member 50 are pressed against the upper face of the banknotes 201 already stored in the storage bag 100. In this step, the stage 40 energized by the spring member is also pushed downward from the position where the stage 40 has supported the banknotes 201 shown in FIG. 11A and FIG. 11B. The pushing member 50 having reached the pushing position moves upward and returns to the retracted position as shown in FIG. 11D. In this step, the pushing film 52 passes through the opening portion 103 of the opened gate while being elastically deformed such that the both outer edges of the pushing film 52 warp downward. After storage of the banknotes 200, the stage 40 energized by the spring member moves upward to press the banknotes 200, 201. The upper face of the uppermost banknote among the banknotes 200 newly stored in the storage bag 100 is pressed against the lower surface of the frame 101. The banknotes 200, 201 sandwiched between the frame 101 and the stage 40 are compressed in the up-down direction. After the pushing process is completed and the pushing member 50 returned to the retracted position, the banknote handling apparatus 1 resumes stacking of banknotes onto the frame 101.

The banknote handling apparatus 1 repeats the stacking process in which a predetermined number of banknotes are stacked on the frame 101 and the pushing process in which the predetermined number of banknotes stacked on the frame 101 are pushed into the storage bag 100. For example, when twenty three banknotes are to be stored in the storage bag 100, the banknote handling apparatus 1 executes, two times, a process of stacking ten banknotes on the frame 101 and pushing these ten banknotes into the storage bag 100, and then performs a process of stacking three banknotes on the frame 101 and pushing these three banknotes into the storage bag 100. Thus, all banknotes are stored in the storage bag 100 by repeating the stacking process and the pushing process three times.

The banknote handling apparatus 1 executes a sealing process of closing the opening portion 103 as shown in FIG. 5 when a predetermined condition is satisfied. The condition for starting the sealing process includes: the number of banknotes stored in the storage bag 100 having reached a predetermined number; the position of the uppermost banknote stored in the storage bag 100 having reached a predetermined position; and the position of the stage 40 having reached a predetermined position. When one of these three conditions is satisfied, the banknote handling apparatus 1 executes the sealing process. Alternatively, a user can manually start the sealing process by operating an operation unit of the banknote handling apparatus 1 or an operation terminal device connected to the banknote handling apparatus 1. When a user performs an operation for instructing start of the sealing process, the banknote handling apparatus 1 executes the sealing process. For example, the sealing process may be executed automatically or manually, but a trigger to start the sealing process is not particularly limited.

Figure 12:
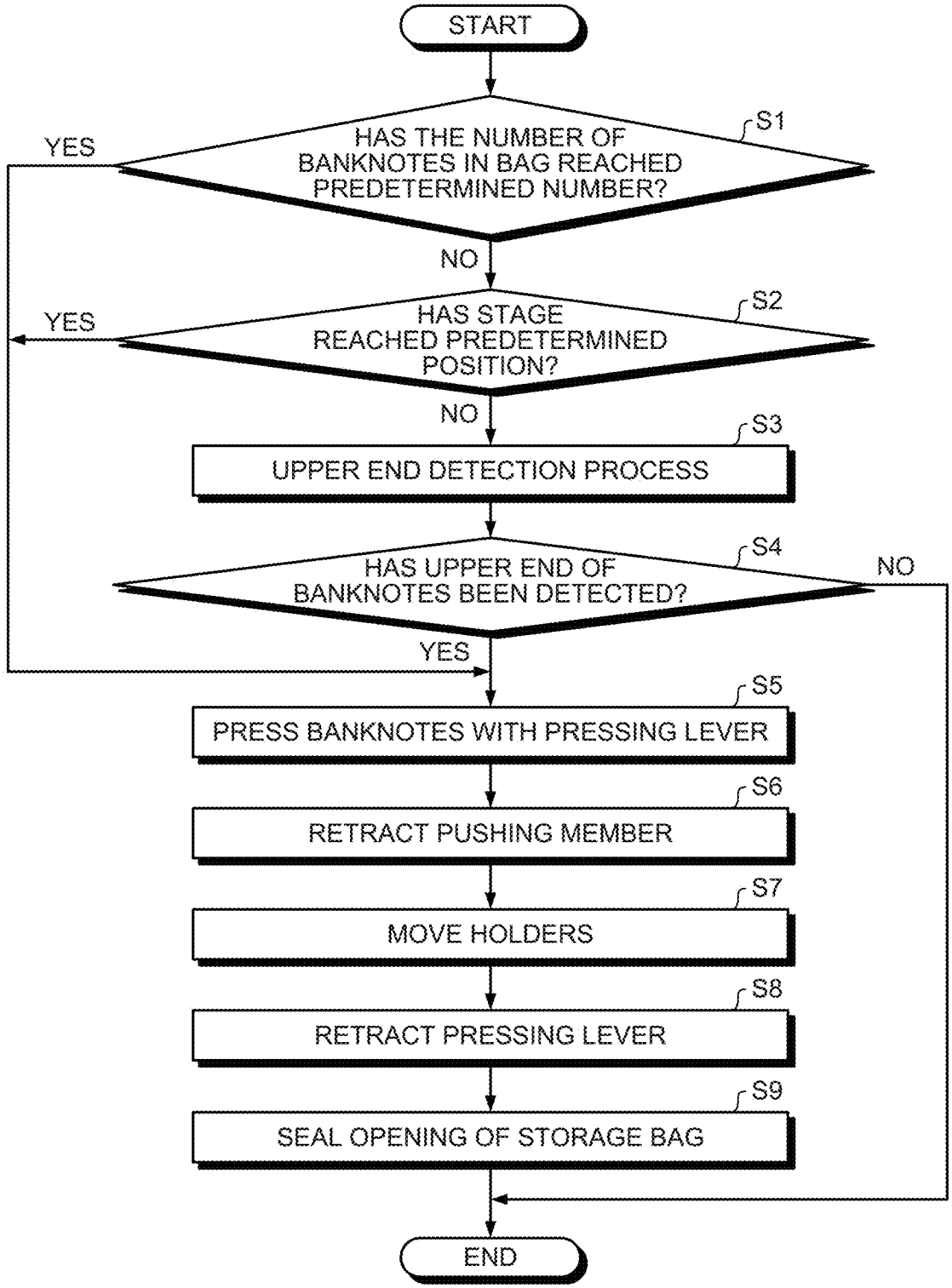
FIG. 12 is a flowchart for explaining a sealing process.

FIG. 12 is a flowchart illustrating a process of determining whether or not the sealing process is to be executed, and the sealing process. Each time the banknote handling apparatus 1 executes the pushing process shown in FIG. 11, the banknote handling apparatus 1 determines whether or not the number of banknotes stored in the storage bag 100 has reached a predetermined number. When the number of the banknotes in the storage bag 100 has reached the predetermined number through repetition of the pushing process, the banknote handling apparatus 1 starts the process shown in FIG. 12 to determine whether or not the sealing process is to be performed.

For example, in a case where the storage bag 100 can store therein 400 to 600 banknotes according to the conditions of the banknotes, when the number of the banknotes stored in the storage bag 100 has reached 150, the process shown in FIG. 12 is started. Thereafter, the process shown in FIG. 12 is executed each time the pushing process is executed.

The banknote handling apparatus 1, which has stored the banknotes into the storage bag 100 through the pushing process, determines whether or not the number of the banknotes stored in the storage bag 100 has reached an upper limit number of banknotes storable in the storage bag 100 (step S1). When the number of the banknotes has reached the upper limit number (step S1: Yes), the banknote handling apparatus 1 determines that no more banknotes can be stored in the storage bag 100, and executes the sealing process (steps S5 to S9).

For example, in a case where the upper limit number of banknotes storable in the storage bag 100 is set to 450, when the number of the banknotes stored in the storage bag 100 has reached 450 (step S1: Yes), the sealing process is executed.

When the number of the banknotes has not reached the upper limit number (step S1: No), the banknote handling apparatus 1 determines whether or not the position of the stage 40 has reached a predetermined position (step S2). The stage 40, which is being energized by the spring member, gradually moves downward according to the number of the banknotes stored in the storage bag 100. When the position of the stage 40 has reached a position set as a lower limit position, the banknote handling apparatus 1 determines that the stage 40 has reached the predetermined position (step S2: Yes). Then, the banknote handling apparatus 1 determines that no more banknotes can be stored in the storage bag 100, and executes the sealing process (steps S5 to S9).

When the stage 40 has not reached the lower limit position (step S2: No), the banknote handling apparatus 1 executes an upper-end detection process (step S3). Regarding the upper-end detection process, it may not necessarily be executed, as shown in FIG. 12, each time the pushing process is executed after the number of the banknotes in the storage bag 100 has reached the predetermined number (e.g., 150). It can be set that the upper-end detection process is executed once each time the pushing process has been executed a plurality of times. For example, the upper-end detection process may be executed each time 20 banknotes are stored in the storage bag 100. In this case, after 150 banknotes have been stored in the storage bag 100 having the upper limit capacity of 450, the upper-end detection process is executed once each time a process of stacking 10 banknotes on the frame 101 and pushing these 10 banknotes into the storage bag 100 is executed two times.

Figure 13A:
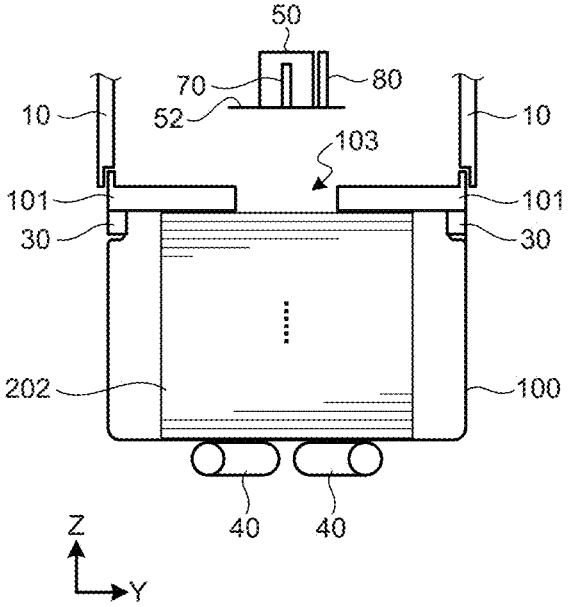
FIGS. 13A to 13D are schematic diagrams illustrating an upper-end detection process.

FIGS. 13A to 13D are schematic diagrams illustrating the upper-end detection process. After the pushing process of pushing banknotes into the storage bag 100, the pushing member 50 returns to the retracted position above the frame 101 as shown in FIG. 13A. In this step, banknotes 202 are pressed against the lower surface of the frame 101 by the stage 40 energized upward by the spring member. After the pushing process, the pushing member 50 returns to the retracted position shown in FIG. 13A. The upper-end detection process is started after the pushing member 50 has returned to the retracted position and it is confirmed that there is no banknotes remaining on the frame 101.

Figure 13B:
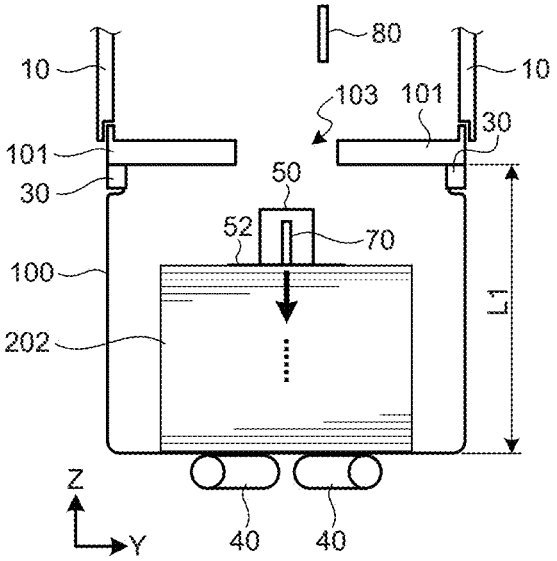

When the upper-end detection process is started, the pushing member 50 moves downward again. The pushing member 50 moves downward from the retracted position shown in FIG. 13 A and pushes the banknotes 202 downward. The banknotes 202 are pushed downward to a position where the upper end of the banknotes 202 is separated away from the lower surface of the frame 101 as shown in FIG. 13B. In this step, the stage driving unit causes the stage 40 to move downward and stop at the predetermined position. As shown in FIG. 13B, the stage 40 stops at the position a distance L1 beneath the lower surface of the frame 101, i.e., the upper surface of the holder 30.

Figure 13C:
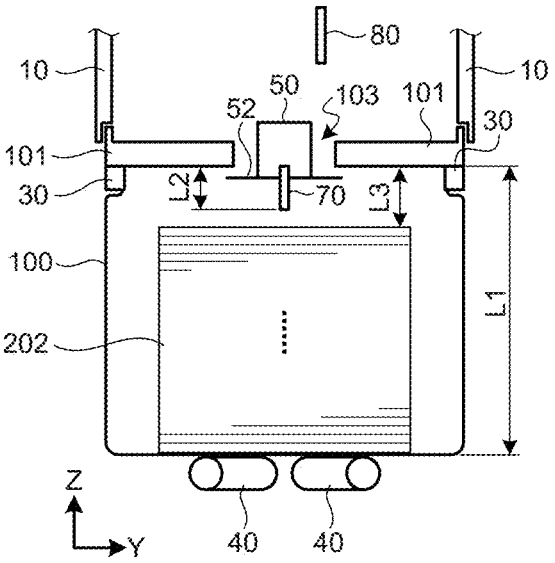

The pushing member 50 moves upward again from the position where it pushed the banknotes 202 downward as shown in FIG. 13B, and stops at a predetermined detection position as shown in FIG. 13C. At the detection position, the detection member 70 is freely pivotable around the shaft 71 as shown in FIG. 9.

If the banknotes 202 do not push the detection member 70 upward when the pushing member 50 stops at the detection position, the detection member 70 does not block the detection light of the sensor 72 shown in FIG. 9, and therefore, the upper end of the banknotes 202 is not detected. Specifically, as shown in FIG. 13C, when a distance L2 from the lower surface of the frame 101 to the detection surface 70*a* of the detection member 70 is smaller than a distance L3 from the lower surface of the frame 101 to the upper end of the banknotes 202 (L2<L3), the upper end of the banknotes 202 is not detected by the sensor 72.

Figure 13D:
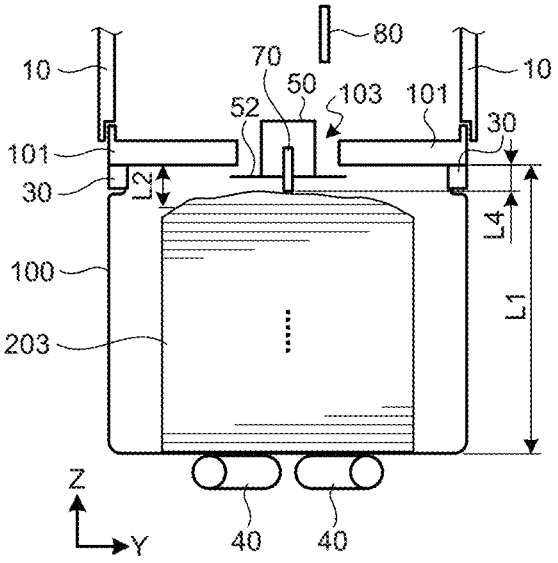

Even when the number of the banknotes 202 shown in FIG. 13C is the same as the number of the banknotes 203 shown in FIG. 13D, if the banknotes 203 include a banknote a part of which bulges due to damage or folding, the stacking height of the banknotes 203 becomes higher than that of the banknotes 202. As a result, the banknotes 203 push the detection member 70 upward, and the detection member 70 blocks the detection light of the sensor 72 shown in FIG. 9, and therefore, the upper end of the banknotes 203 is detected. Specifically, as shown in FIG. 13D, when the detection member 70 is pushed upward by the upper end of the banknotes 203 and a distance L4 from the lower surface of the frame 101 to the detection surface 70*a* of the detection member 70 becomes smaller than the distance L2 shown in FIG. 13C (L4<L2), the upper end of the banknotes 203 is detected by the sensor 72.

When the upper end of the banknotes is not detected by using the detection member 70 (FIG. 12, step S4: No), the banknote handling apparatus 1 ends the process shown in FIG. 12 without executing the sealing process (steps S5 to S9). On the other hand, when the upper end of the banknotes is detected by using the detection member 70 (step S4: Yes), the banknote handling apparatus 1 determines that no more banknotes can be stored in the storage bag 100, and executes the sealing process (steps S5 to S9).

As described above, when the number of the banknotes in the storage bag 100 has reached the upper limit number (step S1: Yes), when the position of the stage 40 has reached the lower limit position (step S2: Yes), or when the upper end of the banknotes has been detected by using the detection member 70 through the upper-end detection process (step S4: Yes), the banknote handling apparatus 1 automatically executes the sealing process (steps S5 to S9).

Figure 14A:
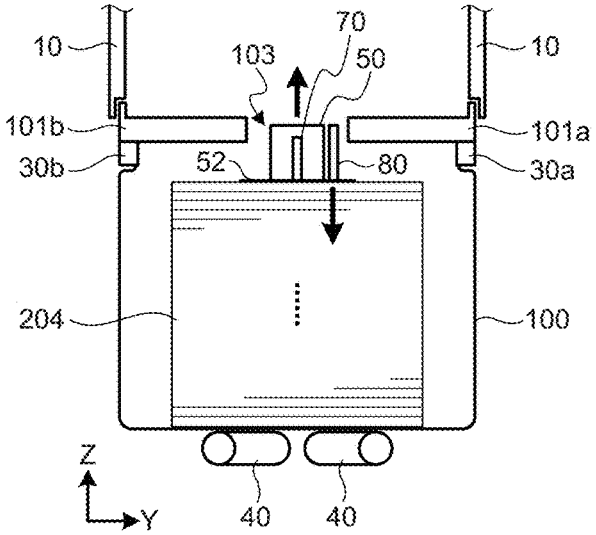
FIGS. 14A to 14D are schematic diagrams illustrating a sealing process.

FIGS. 14A to 14D are schematic diagrams illustrating the sealing process. The sealing process is a process of closing the opening portion of the storage bag 100, i.e., the opening portion 103 of the frame 101. After the pushing process or the upper-end detection process, the pushing member 50 returns to the retracted position. The sealing process is started after the pushing member 50 has returned to the retracted position and it is confirmed that there is no banknotes remaining on the frame 101. After starting the sealing process, the banknote handling apparatus 1 moves the pushing member 50 downward to the pushing position as shown in FIG. 14A, and then releases the pressing member 80 from the locking member 83 as indicated by the solid line in FIG. 10. As shown in FIG. 14A, the pressing member 80 energized by the spring member moves downward, and presses banknotes 204 in the storage bag 100 (FIG. 12, step S5). Then, the banknote handling apparatus 1 moves the pushing member 50 upward while the pressing member 80 continues to press the banknotes 204.

Figure 14B:
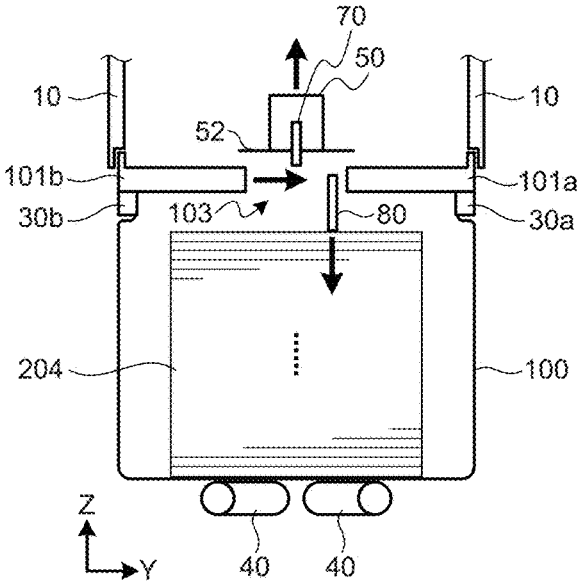

As shown in FIG. 14B, the pushing member 50 retracts to the outside of the storage bag 100, i.e., retracts upward away from the upper surface of the frame 101, while the pressing member 80 holds the banknotes 204 (FIG. 12, step S6). After the pushing member 50 retracted to outside of the storage bag 100, the holder 30*b* holding one frame member 101*b* of the frame 101 starts to move toward the holder 30*a* holding the other frame member 101*a* of the frame 101 (step S7).

Figure 14C:
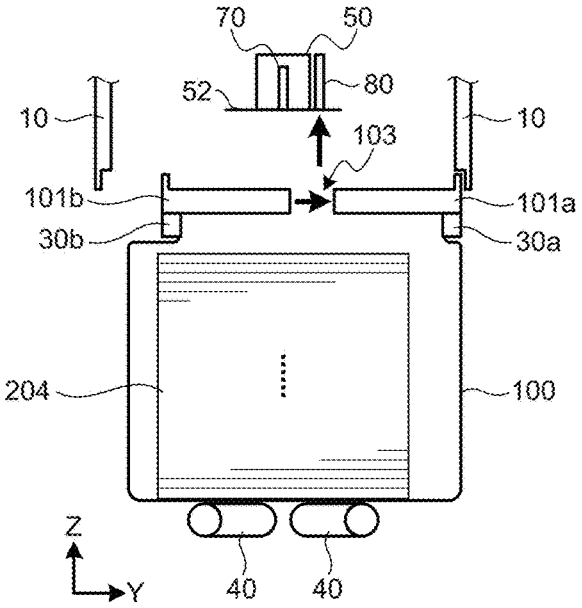

As shown in FIG. 14C, while the holder 30*b* holding the frame member 101*b* is moving to close the opening portion 103 of the frame 101, the pressing member 80 is lifted upward by the pushing member 50 that is further moving upward from the position shown in FIG. 14B. The pressing member 80 retracts to the outside of the storage bag 100, i.e., retracts upward away from the upper surface of the frame 101 (FIG. 12, step S8). Specifically, as described with reference to FIG. 10, the pressing member 80 is lifted upward by the storage pin 50*e* of the pushing member 50 that continue to move upward, and then the pressing member 80 is locked by the locking member 83.

Figure 14D:
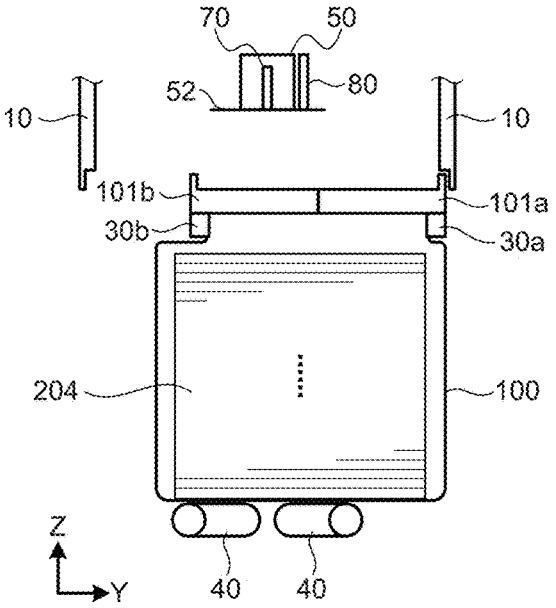

The holder 30*b* holding the frame member 101*b* of the frame 101 continues to move toward the holder 30*a* holding the frame member 101*a* of the frame 101 while the pushing member 50 and the pressing member 80 are moving upward. Then, the connecting portions 111 of the frame member 101*a* are engaged with the connecting portions 112 of the frame member 101*b* as shown in FIG. 5B, whereby the opening portion 103 of the frame 101 is closed and fixed as shown in FIG. 14D (FIG. 12, step S9). The opening portion of the storage bag 100 is closed by closing the opening portion 103 of the frame 101.

After the holder 30 closes the opening portion of the storage bag 100, the mounting unit 20 is drawn out from the banknote handling apparatus 1, and the storage bag 100 having the banknotes stored therein is dismounted from the mounting unit 20 and collected from the banknote handling apparatus 1.

In the present embodiment, as shown in FIG. 6, the stage 40 includes the two opposing members 40*a*, 40*b* that are bent such that the gaps between the opposed end parts are wider than the gap between the center parts. However, the configuration of the stage 40 is not limited thereto. For example, the opposing members 40*a*, 40*b* shown in FIG. 6 may be composed of only the center parts having the narrow gap therebetween, and supported by the support member 40*c*. The stage 40 is not limited to the configuration in which the opposing members 40*a*, 40*b* are supported by the support member 40*c*. For example, the stage 40 may be a plate-like body of which a part is cut out in the same shape as the gap between the opposing members 40*a*, 40*b* shown in FIG. 6.

Figure 15A:
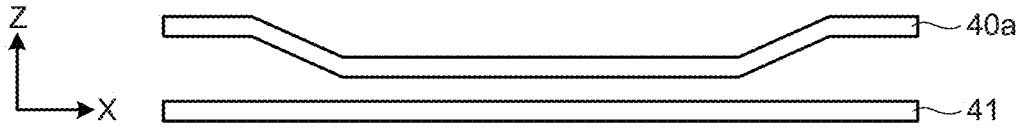
FIGS. 15A to 15C show other examples of a stage.
Figure 15B:
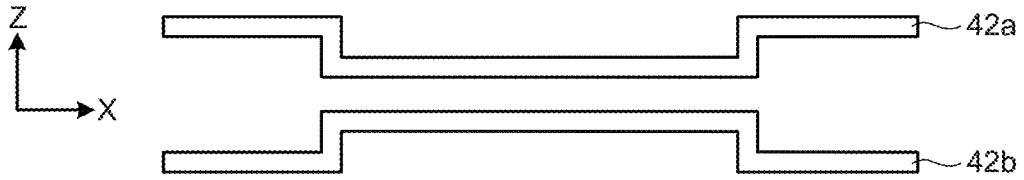
Figure 15C:
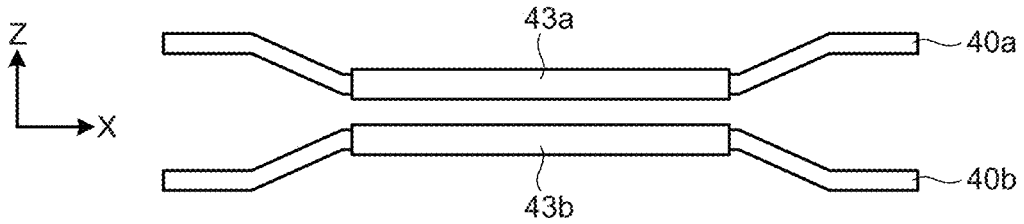

FIGS. 15A to 15C show other examples of the stage 40. Other members having shapes different from the opposing members 40*a*, 40*b* can be used for the stage 40 as long as the gaps at the both outer sides are wider than the gap at the center part. As shown in FIG. 15A, one member 40*a* may have a bent shape while the other member 41 may have a linear shape. The gaps between the both outer sides may not necessarily be gradually increased. As shown in FIG. 15B, two opposing members 42*a*, 42*b* each being bent to form a rectangular U shape may be disposed facing each other such that the gaps at the both outer sides are wider than the gap at the center part. In this example, one of the members 42*a*, 42*b* may have a linear shape as in the example of FIG. 15A. As shown in FIG. 15C, the opposing members 40*a*, 40*b* may be inserted in hollow pipes 43*a*, 43*b* each having a circular sectional circumference such that the hollow pipes 43*a*, 43*b* are rotatable at the center part having the narrow gap. The rotatable hollow pipes 43*a*, 43*b* at the center part having the narrow gap enable the stage 40 to easily move upward and downward while the lower part of the bag body 102 is being inserted in the gap. Also, in this example, one of the members 40*a*, 40*b* may have a linear shape.

Figure 16A:
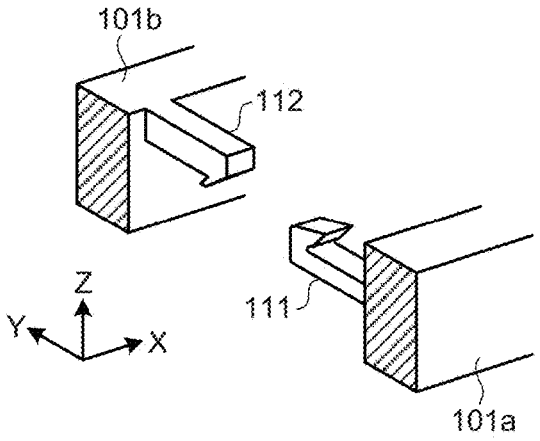
FIGS. 16A to 16C show other examples of connecting portions for closing the frame.
Figure 16B:
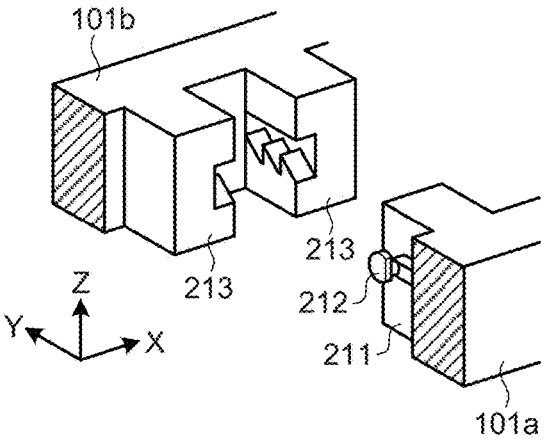
Figure 16C:
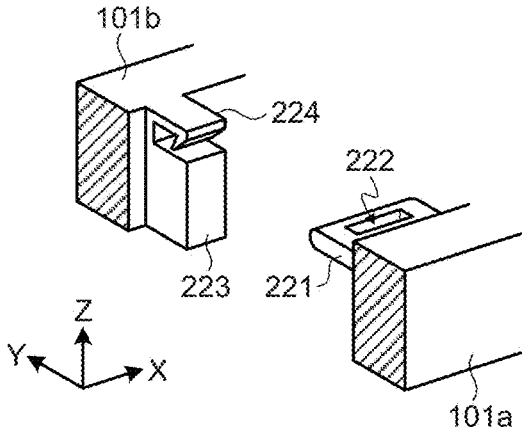

In the present embodiment, as shown in FIG. 5, the opening portion 103 of the frame 101 is closed by using the hook-shaped connecting portions 111, 112 formed at the opposed side surfaces of the frame members 101*a*, 101*b* of the frame 101. However, the configuration for closing the frame 101 is not limited thereto. FIGS. 16A to 16C show other examples of the connecting portions for closing the frame 101. In FIG. 5, the projections of the connecting portions 111, 112 are formed in the longitudinal direction of the frame 101 (X-axis direction). However, the direction of the projections is not limited. For example, as shown in FIG. 16A, projections may be formed in the up-down direction. For example, in the X-axis direction, the width of the connecting portion 112 shown in FIG. 16A may be wider than the width of the connecting portion 111. The increased width of the connection portion 112 facilitates connection with the connecting portion 111. The connecting portion 111 may not necessarily elastically deform to be engaged with the connecting portion 112, as long as at least one of the connecting portion 111 and the connecting portion 112 elastically deform. Furthermore, the connecting portion 111 may not necessarily be broken when the frame 101 once closed is forcibly opened, as long as at least one of the connecting portion 111 and the connecting portion 112 is broken.

As shown in FIG. 16B, projections 212 may be formed at both side surfaces of a connecting portion 211 of the frame member 101*a* while connecting portions 213 having saw-tooth-shaped grooves to engage with the projections 212 may be formed on the other frame member 101*b*. Since the projections 212 of the connecting portion 211 can be inserted into the grooves of the connecting portion 213 but cannot be pulled out from the grooves, the frame 101 can be closed by connecting the connecting portions 211 and the connecting portions 213 with each other. The shape of the axial part of the projection 212 is adjusted according to the material thereof such that the projection 212 is broken when the frame 101 once closed is forcibly opened.

As shown in FIG. 16C, a connecting portion 221 having a hole 222 may be formed on the frame member 101*a* while a connecting portion 223 having a hook 224 corresponding to the hole 222 may be formed on the other frame member 101*b*. Since the hook 224 of the connecting portion 223 of the frame member 101*b* can be engaged with the hole 222 of the connecting portion 221 of the frame member 101*a* but cannot be removed from the hole 222, the frame 101 can be closed by connecting the connecting portions 221 and the connecting portions 223 with each other. The shape of the root portion of the hook 224 is adjusted according to the material thereof such that the hook 224 is broken when the frame 101 once closed is forcibly opened.

In the present embodiment, the pressing member 80 is energized by the spring member. However, the method for driving the pressing member 80 is not particularly limited as long as the pressing member 80 can be energized to press the banknotes. For example, a driving unit using a motor or a solenoid may be used to drive and energize the pressing member 80.

In the present embodiment, banknotes are stored in the storage bag 100. However, an object to be stored in the storage bag 100 is not limited to banknotes. For example, the storage bag 100 may store therein sheets such as checks, coupons, and securities. When a sheet handling apparatus for handling these sheets is provided with the storage mechanism 10, the sheets can be stored in the storage bag 100 as described above. Alternatively, for example, the storage bag 100 may store coins therein. When a money handling apparatus for handling banknotes and coins or a coin handling apparatus for handling coins is provided with the storage mechanism 10, coins can be stored in the storage bag 100 as described above.

In the present embodiment, a sheet handling apparatus is configured to store sheets into a storage bag. The storage bag includes a frame and a bag body fixed to the frame. The frame includes a gate for opening and closing an opening of the storage bag. The sheet handling apparatus includes: a mounting unit to which the frame of the storage bag is detachably mounted; a transport unit configured to transport the sheets one by one; and a storage mechanism configured to stack the sheets transported by the transport unit, in a stacking area on the frame mounted to the mounting unit, and to push the sheets stacked in the stacking area into the storage bag through the opening of the storage bag to store the sheets in the storage bag.

In the above configuration, the storage mechanism stacks the sheets on the frame of the storage bag.

In the above configuration, the gate of the frame includes a first member and a second member. The sheets are stacked in the stacking area on the first member and the second member.

In the above configuration, the frame has a shape to prevent the sheets stacked on the first member and the second member from jumping out from the stacking area.

In the above configuration, the sheet handling apparatus further includes a driving unit configured to move at least one of the first member and the second member in a parallel direction to close the opening of the storage bag.

In the above configuration, the mounting unit includes a first holder and a second holder that hold a part of the storage bag near the opening. The driving unit is configured to move the second holder toward the first holder to close the opening of the storage bag.

In the above configuration, the mounting unit includes a first holder and a second holder that hold a part of the storage bag near the opening. The driving unit causes the second holder to move toward the first holder to close the opening of the storage bag.

In the above configuration, the frame is mounted to and dismounted from the mounting unit by means of snap-fit.

In the above configuration, the mounting unit has at least one hole formed in a first direction and at least one hole formed in a second direction different from the first direction. The frame has insertion portions corresponding to the respective holes of the mounting unit. The frame is mounted to the mounting unit with the respective insertion portions being inserted to the corresponding holes of the mounting unit.

In the present embodiment, a sheet handling method for storing sheets in a storage bag that includes an opening and a frame having a gate for opening and closing the opening includes: transporting sheets one by one, by a transport unit; stacking, by a storage mechanism, the sheets in a stacking area on the frame, which is capable of being detachably mounted to a mounting unit, of the storage bag; and pushing, by the storage mechanism, the sheets stacked in the stacking area into the storage bag through the opening to store the sheets in the storage bag.

The sheet handling apparatus according to the present embodiment use the frame of the storage bag as a part of the stacking area in which sheets are stacked. For example, a plurality of sheets are stacked on the frame of the storage bag, and the stacked sheets are pushed into the storage bag through the opening formed in the frame, and stored in the storage bag. Thus, a stacking unit for stacking sheets need not be provided separately from the storage bag, and members, on which the sheets are stacked and which pivot to store the stacked sheets in the storage bag, are not necessary, whereby it is possible to save area for stacking and storing sheets in the storage bag.

As described above, in the sheet handling apparatus according to the present embodiment, the storage bag can be easily mounted to and dismounted from the mounting unit of the apparatus. The sheet handling apparatus can stack sheets on the frame of the storage bag. The sheet handling apparatus can store a plurality of stacked sheets simultaneously into the storage bag through the opening portion formed in the frame. When the storage of the sheets into the storage bag has ended, the sheet handling apparatus can close the frame of the storage bag to prevent the stored sheets from getting out of the storage bag. Since the frame of the storage bag is used for stacking sheets, an independent structure for stacking sheets is not necessary, whereby space-saving regarding stacking and storage of sheets can be realized.

As described above, the sheet handling apparatus and the sheet handling method according to the present embodiment are useful for saving space for stacking and storing sheets.

What is claimed is:

1. A sheet handling apparatus to store sheets fed into inside of the sheet handling apparatus into a storage hag that includes an opening portion and a frame having a gate for opening and closing the opening portion, the sheet handling apparatus comprising:

a mount to which the frame of the storage bag is capable of being detachably mounted;

a transport to transport the fed sheets one by one;

a storage chamber to stack the sheets transported by the transport, in a stacking area on the frame mounted to the mount; and a pushing member to push the sheets stacked in the stacking area into inside of the storage bag through the opening portion of the storage bag which is being opened by the gate, wherein an upper surface of the frame serves as a stacking surface on which the sheets fed into inside of the sheet handling apparatus are stacked in the stacking area.

2. The sheet handling apparatus according to claim 1, further comprising:

an inlet through which sheets are fed into inside of the sheet handling apparatus.

3. The sheet handling apparatus according to claim 1, wherein the gate of the frame includes a first member and a second member disposed facing each other, and the sheets transported by the transport are stacked in the stacking area on the first member and the second member.

4. The sheet handling apparatus according to claim 3, wherein the frame has a shape to prevent the sheets stacked on the first member and the second member from jumping out from the stacking area.

5. The sheet handling apparatus according to claim 3, further comprising a driver to move at least one of the first member and the second member to close the opening portion of the storage bag.

6. The sheet handling apparatus according to claim 5, wherein the mount includes a first holder and a second holder to bold a part of the storage bag near the opening portion, and the driver moves the second holder toward the first holder to close the opening portion of the storage bag.

7. The sheet handling apparatus according to claim 5, wherein the mount includes a first holder and a second holder to hold the frame of the storage bag, and the driver moves the second holder toward the first holder to close the opening portion of the storage bag.

8. The sheet handling apparatus according to claim 1, wherein the frame is mounted to and dismounted front the mount by means of snap-fit.

9. The sheet handling apparatus according to claim 1, wherein the mount has at least one hole formed in a first direction and at least one hole formed in a second direction different from the first direction, the frame has insertion portions corresponding to the respective holes of the mount, and the frame is mounted to the mount t with the respective insertion portions being inserted to the corresponding holes of the mount.

10. The sheet handling apparatus according to claim 1, wherein the mount includes a holder to hold the frame of the storage bag.

11. The sheet handling apparatus according to claim 10, wherein the storage bag is removable from the holder when the opening portion of the storage hag is closed by the gate.

12. The sheet handling apparatus according to claim 1, wherein an upper surface of the frame mounted to the mount is substantially horizontal.

13. The sheet handling apparatus according to claim 1, wherein the pushing member moves downward and push the sheets stacked on the frame into the storage bag through the opening portion when a number of the stacked sheets reaches a predetermined number of sheets and the gate opens the opening portion.

14. The sheet handling apparatus according to claim 1, wherein the storage chamber further includes a pressing member to press downward from above the sheets stored in the storage bag while the gate of the frame is moving to close the opening portion of the storage bag.

* * * * *